US007294778B2

(12) United States Patent
Susami

(10) Patent No.: US 7,294,778 B2
(45) Date of Patent: Nov. 13, 2007

(54) PERCUSSION INSTRUMENT, SYSTEM, AND METHOD WITH CLOSING POSITION DETECTION

(75) Inventor: Ryo Susami, Inasa-gun, Hosoe-cho (JP)

(73) Assignee: Roland Corporation, Hamamatsu (JP)

( * ) Notice: Subject to any disclaimer, the term of this patent is extended or adjusted under 35 U.S.C. 154(b) by 185 days.

(21) Appl. No.: 11/026,040

(22) Filed: Dec. 30, 2004

(65) Prior Publication Data

US 2005/0145102 A1 Jul. 7, 2005

(30) Foreign Application Priority Data

Jan. 7, 2004 (JP) ..... 2004-002341

(51) Int. Cl.
*G10H 3/00* (2006.01)

(52) U.S. Cl. ..... 84/723; 84/725; 84/730; 84/735; 84/411 R; 84/411 P

(58) Field of Classification Search ..... None
See application file for complete search history.

(56) References Cited

U.S. PATENT DOCUMENTS 6,815,604 B2 * 11/2004 Toda ..... 84/746
7,015,391 B2 * 3/2006 Tomoda ..... 84/726
2003/0188629 A1 * 10/2003 Suenaga ..... 84/723
2004/0083873 A1 * 5/2004 Yoshino et al. ..... 84/107
2005/0145101 A1 * 7/2005 Yoshino ..... 84/723

FOREIGN PATENT DOCUMENTS

JP 09-97075 4/1997

* cited by examiner

*Primary Examiner*—Marlon Fletcher
(74) *Attorney, Agent, or Firm*—Foley & Lardner LLP

(57) ABSTRACT

An electronic percussion instrument includes input means, correction information storage means, and musical tone generation means. The input means allows for vibration information, which expresses a vibration of an operator, position information, which expresses a position of the operator, and standard position information, which indicates a standard position of the operator, to be input. The correction information storage means allows for correction information to be stored that is based on the position information that has been input in the input means that corresponds to the standard position information that has been input in the input means. The musical tone generation means allows for the generation of a musical tone in conformance with the position information that has been input in the input means that corresponds to the vibration information that has been input and the correction information that has been stored in the correction information storage means.

36 Claims, 12 Drawing Sheets

PERCUSSION INSTRUMENT, SYSTEM, AND METHOD WITH CLOSING POSITION DETECTION

CROSS-REFERENCE TO RELATED PATENT APPLICATIONS

Japan Priority Application 2004-002341, filed Jan. 7, 2004 including the specification, drawings, claims, and abstract, is incorporated herein by reference in its entirety.

BACKGROUND OF THE INVENTION

1. Field of the Invention

Embodiments of the present invention relate to an electronic percussion instrument and, in particular embodiments, to an electronic percussion instrument in which, in an electronic hi-hat cymbal, the position information that has been output from a displacement sensor when a closed state of the two upper and lower cymbals has been detected is referred to and a musical tone having a suitable timbre in conformance with an operation position can be generated in accordance with an appropriate correction of the position information for the closed position, which is the standard position information.

2. Related Art

For some time, electronic percussion instruments have been provided that mimic acoustic hi-hat cymbals and, with this kind of electronic percussion instrument, the configuration is such that the timbre of the hi-hat is controlled in conformance with the amount of stepping on the foot pedal, in other words, the amount of the displacement of the upper cymbal based on the stepping on the foot pedal. For example, in Japanese Laid-Open Patent Application Publication (Kokai) Number Hei 9-97075 (Patent Reference 1), a sensor (a displacement sensor), which is disposed in the foot pedal for the detection of the amount that the foot pedal has been stepped on, is disclosed.

However, in the case of, for example, the displacement sensor cited in Patent Reference 1, the actual output range of sensor values that are detected deviate from the output range of sensor values that has been prescribed in advance due to causes such as errors because of the variations in the sensor values that are detected and the like. The variations in the sensor values are caused by a component related problem of the sensor such as, for example, the degree of deterioration of the coil spring or the detection precision of the sensor sheet section.

On the other hand, in electronic percussion instruments of the past, in those cases where, because it has been configured such that a musical tone control value is read out for the output range of sensor values that has been prescribed in advance, an output value that is outside the output range of sensor values that has been prescribed in advance has been detected. Thus, there has been the problem that a dead zone is produced and, because of this, the timbre that is generated is affected because the generation range of the tightly closed sound becomes narrow and the generation range of the open sound becomes wide and the like.

FIG. 12 is a drawing for the purpose of concretely explaining problem areas such as those described above. FIG., 12(*a*) is a drawing that shows conceptually the relationship between the output range of the displacement sensor values that has been designated in advance and the timbre, and five types of hi-hat sounds (open sound, half open sound, slightly open sound, closed sound, and tightly closed sound) are each coordinated for the output range of the displacement values.

FIG. 12(*b*) is a drawing that shows conceptually the case in which the output range of the displacement sensor values that have actually been detected has been shifted in the negative direction, and due to the fact that the displacement sensor values are shifted in the negative direction, the generation region for the open sound becomes wide and, on the other hand, the generation region for the tightly closed sound is extinguished. In addition, FIG. 12(*c*) is a drawing that shows conceptually the case in which the output range of the displacement sensor values that have actually been detected has been shifted in the positive direction and due to the fact that the displacement values are shifted in the positive direction, the generation region for the open sound becomes narrow and, on the other hand, the generation region for the tightly closed sound becomes wide.

SUMMARY OF THE DISCLOSURE

Embodiments of the present invention address problems as discussed above and relate to an electronic percussion instrument, system, and process with which the position information that has been output from the displacement sensor when a closed position has been detected is referred to. By suitable correction of the position information that corresponds to the closed position, the position information that is actually detected is detected relatively accurately and, as a result, a musical tone can be generated having an appropriate timbre in conformance with an operation position.

An electronic percussion instrument in accordance with a first embodiment is furnished with input means with which the vibration information, which expresses the vibration of an operator, the position information, which expresses the position of the operator, and the standard position information, which indicates the standard position of the operator, are input, and correction information storage means with which, when the standard position information is input in the input means, correction information based on the position information that has been input in the input means that corresponds to the standard position information that has been input is stored, and musical tone generation means with which, when the vibration information has been input in the input means, a musical tone is generated in conformance with the position information that has been input in the input means that corresponds to the vibration information that has been input and the correction information that has been stored in the correction information storage means.

By means of an electronic percussion instrument in accordance with the first embodiment, when the standard position information that indicates that the operator is at the standard position is input by the input means, the correction information that is based on the position information that expresses the position of said operator that has been input in said input means that corresponds to the standard position information that has been input is stored in the correction information storage means. On the other hand, when the vibration information that expresses the vibration of said operator is input in said input means, a musical tone is generated from the musical tone generation means in conformance with said position information that has been input in said input means that corresponds to the vibration information that has been input and the correction information that has been stored in said correction information storage means.

An electronic percussion instrument in accordance with a second embodiment is furnished with musical tone control information acquisition means with which musical tone control information is acquired from the position information that has been input in the input means that corresponds to the vibration information that has been input in the input means based on a specified function, and the musical tone generation means is one that generates a musical tone based on the musical tone control information that has been acquired from the musical tone control information acquisition means.

An electronic percussion instrument in accordance with a third embodiment is also furnished with musical tone control means with which, during the generation of the musical tone by the musical tone generation means, the musical tone is controlled during the generation based on the position information that has been input by the input means and the correction information that has been stored in the correction information storage means.

An electronic percussion instrument in accordance with a fourth embodiment is furnished with vibration information detection means in which the vibration information that expresses the vibration of an operator is detected, and position information acquisition means in which the position information that expresses the position of the operator is acquired, and standard position detection means in which the standard position information that indicates the fact that the position of the operator is in the standard position is detected, and correction information storage means in which, when the standard position information is detected by the standard position detection means, the correction information that is based on the position information that has been acquired by the position information acquisition means that corresponds to the standard position that has been detected is stored, and musical tone generation means in which, when the vibration information is detected by the vibration information detection means, the musical tone is generated in conformance with the position information that has been acquired by the position information acquisition means that corresponds to the vibration information that has been detected and the correction information that has been stored in the correction information storage means.

By means of an electronic percussion instrument in accordance with the fourth embodiment, when the standard position information that indicates that the position of the operator is the standard position is detected by the standard position detection means, the correction information that is based on the position information that is the position information of said operator that has been acquired by the position information acquisition means and that corresponds to said standard position information that has been detected is stored in the correction information storage means. On the other hand, when the vibration information that expresses the vibration of said operator is detected by the vibration information detection means, a musical tone is generated from the musical tone generation means in conformance with the position information that corresponds to said vibration information that has been detected that has been acquired by said position information acquisition means and the correction information that has been stored in said correction information storage means.

An electronic percussion instrument in accordance with a fifth embodiment is furnished with musical tone control information acquisition means in which the musical tone control information is acquired from the position information that has been acquired by the position information acquisition means that corresponds to the vibration information that has been detected by the vibration detection means based on a specified function, and the musical tone generation means is one in which the musical tone is generated based on the musical tone control information that has been acquired by the musical tone control information acquisition means.

An electronic percussion instrument in accordance with a sixth embodiment is furnished with musical tone control means in which, during the generation of the musical tone by the musical tone generation means, the musical tone is controlled during the generation based on the position information that has been acquired by the position information acquisition means and the correction information that has been stored in the correction information storage means.

By means of an electronic percussion instruments in accordance with the first and second embodiments, when the standard position information that indicates that the operator is at the standard position is input by the input means, the correction information that is based on the position information that expresses the position of said operator that has been input in the input means that corresponds to the standard position information is stored in the correction information storage means. On the other hand, when the vibration information that expresses the vibration of said operator that has been input in said input means is input, a musical tone is generated from the musical tone generation means in conformance with said position information that has been input in said input means that corresponds to the vibration information and the correction information that has been stored in said correction information storage means. In particular, the musical tone control information is acquired by the musical tone control information acquisition means from the position information that has been input with said input means based on a specified function, and the musical tone is generated based on the musical tone control information. Therefore, since each time that the operator is detected to be at the standard position, correction information is acquired based on the position information at that time, it is possible to always acquire the appropriate musical tone control information. Accordingly, there is the advantageous result that even in those cases where, for example, a shift from the position that was originally the standard position has occurred, it is possible to generate an appropriate musical tone in conformance with the position of the operator by means of the musical tone control information that is acquired as described above, which is always appropriate.

By means of an electronic percussion instrument in accordance with the third embodiment, in addition to the advantageous result that is exhibited by the electronic percussion instruments in accordance with the first and second embodiments, since during the generation of the musical tone, the musical tone is controlled during said generation by the musical tone control means based on said position information that has been input with said input means and the correction information that has been stored in said correction information storage means, there is the advantageous result that, even during the sound generation, the generation of a musical tone that is not affected by the shift from the original standard position and that is always appropriate is possible.

By means of an electronic percussion instruments in accordance with the fourth and fifth embodiments, when the standard position information that indicates that the operator is at the standard position is detected by the standard position detection means, the correction information that is based on the position information that is the position information that expresses the position of said operator that is acquired by the position information acquisition means and that corresponds to said standard position information is stored in the correction information storage means. On the other hand, when the vibration information that expresses the vibration of said operator is detected by the vibration information detection means, a musical tone is generated from the musical tone generation means in conformance with the position information that has been acquired by said position information acquisition means and the correction information that has been stored in said correction information storage means. In particular, the musical tone control information is acquired by the musical tone control information acquisition means from the position information that has been acquired by said position information acquisition means based on a specified function, and a musical tone is generated based on the musical tone control information. Therefore, since each time that the operator is detected to be at the standard position, the correction information is acquired based on the position information at that time, it is always possible to acquire the appropriate musical tone control information. Accordingly, there is the advantageous result that even in those cases where a shift in the position that originally was the standard position occurs, it is possible to generate an appropriate musical tone in conformance with the position of the operator by means of the musical tone control information, which is always appropriate, that is acquired as described above.

By means of an electronic percussion instrument in accordance with the sixth embodiment, in addition to the advantageous result that is exhibited by the electronic percussion instruments in accordance with the fourth and fifth embodiments, since during the generation of the musical tone, the musical tone is controlled during said generation by the musical tone control means based on the position information that has been acquired by said position information acquisition means and the correction information that has been stored in said correction information storage means, there is the advantageous result that even during the sound production, it is always possible for an appropriate musical tone to be generated without the tone being affected by the shift from the original standard position.

DETAILED DESCRIPTION OF PREFERRED EMBODIMENTS

Figure 1:
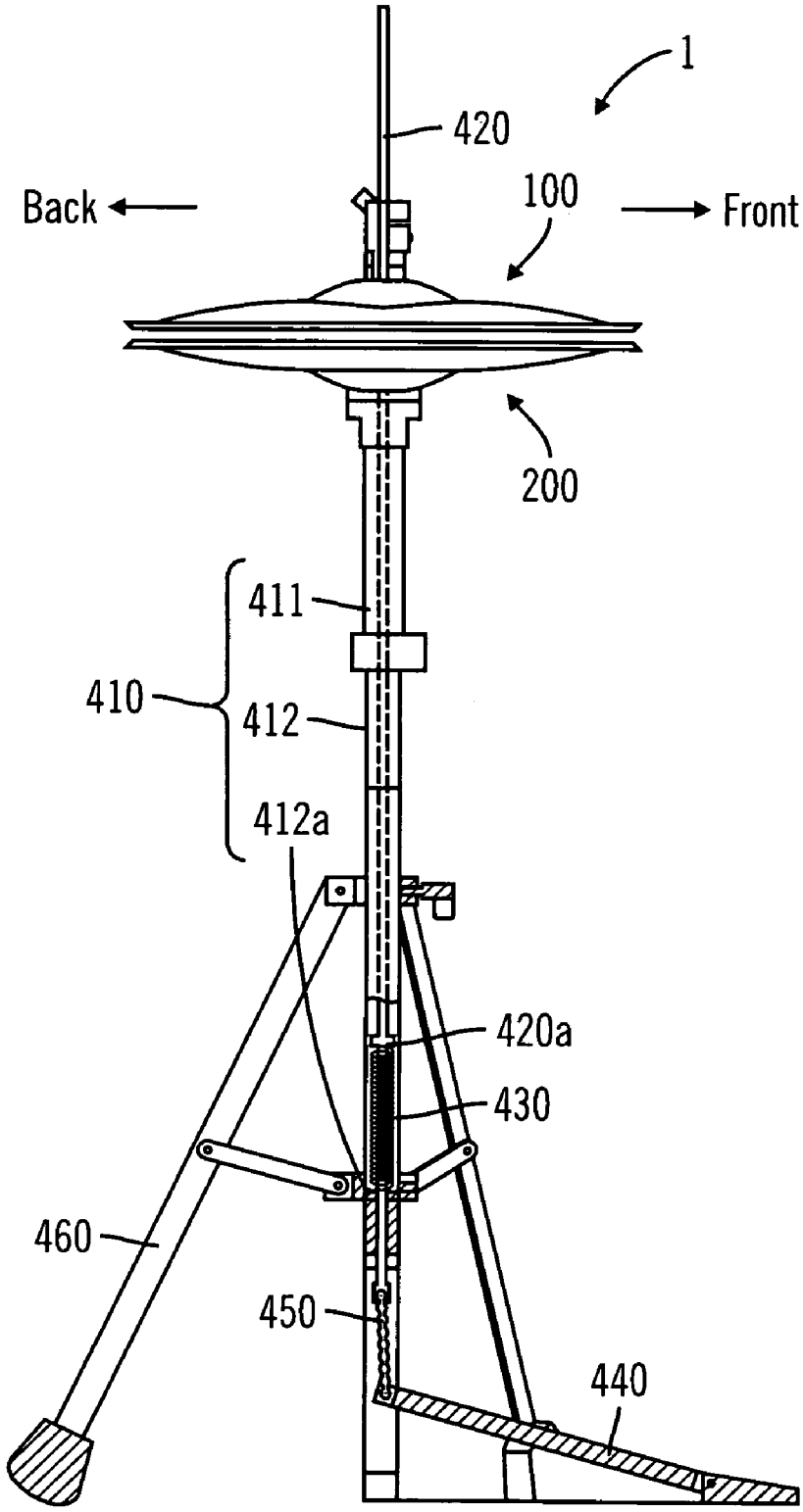
FIG. 1 is a lateral cross-section drawing of an electronic percussion instrument in accordance with an embodiment of the invention.

Explanations will be given below regarding embodiments while referring to the attached drawings. FIG. 1 is a lateral cross-section drawing of an electronic hi-hat cymbal, which is an electronic percussion instrument 1 of an embodiment. In order to simplify the drawing, the detailed structures of the upper cymbal or pad 100, the lower cymbal or pad 200, and the portion that is between the upper cymbal 100 and the lower cymbal 200 have been depicted shortened in the drawing.

The electronic percussion instrument 1 that is shown in FIG. 1 is furnished with an upper cymbal 100, a lower cymbal 200, an extension rod 420 to which the upper cymbal 100 is linked such that the cymbal can swing, and a hollow shaft section 410 to which the lower cymbal 200 is linked such that the cymbal can swing. The electronic percussion instrument 1 is also furnished with a spring 430 that is fit into the inside lower end of the hollow shaft section 410, a step-on type pedal 440, a joint 450 with which the extension rod 420 and the pedal 440 are linked, leg sections 460 for standing up and supporting the entire electronic percussion instrument 1 that are linked to the hollow shaft section 410, and the like.

The hollow shaft section 410 is configured comprising the upper hollow shaft 411 and a lower hollow shaft 412. The lower hollow shaft 412 has an inside diameter that is greater than the outside diameter of the upper hollow shaft 411. With the hollow shaft section 410, the upper hollow shaft 411 is inserted into the lower hollow shaft 412 and the height of the hollow shaft 410 is determined by altering the depth of the insertion. By this means, the height of the lower cymbal 200, which is linked to the upper section (the upper hollow shaft 411) of the hollow shaft section 410 by the linkage fitting, is determined. In addition, the joint section

412*a* is disposed on the lower end of the lower hollow shaft 412. The inside diameter of the lower hollow shaft 412 is held in the joint section 412*a* and supports the spring 430 that is fit into the inside from the bottom.

The extension rod 420 is linked on the bottom to the pedal 440 through the joint 450, and the configuration is such that the extension rod 420 moves up and down in conformance with the stepping operation of the pedal 440. On the other hand, the upper cymbal 100 is linked to the top of the extension rod 420 by the linkage fitting such that the cymbal can swing. When the extension rod 420 moves up and down in conformance with the stepping operation of the pedal 440, the upper cymbal 100 moves up and down in concert with this.

With regard to the extension rod 420, the lower portion passes through the upper hollow shaft 411 and the lower hollow shaft 412 and together with this, also passes through the spring 430 that has been fit into the inside of the lower hollow shaft 412. The spring 430 is held between the bottom of the joint section 420*a* that is disposed on the extension shaft rod 420 and the top of the joint section 412*a* of the lower hollow shaft 412. Since the extension rod always receives a force applied that impels the rod upward because of this, when a stepping operation of the pedal 440 is not carried out, the upper cymbal 100 and the lower cymbal 200 are separated by a specified interval.

Figures 2A, 2B:
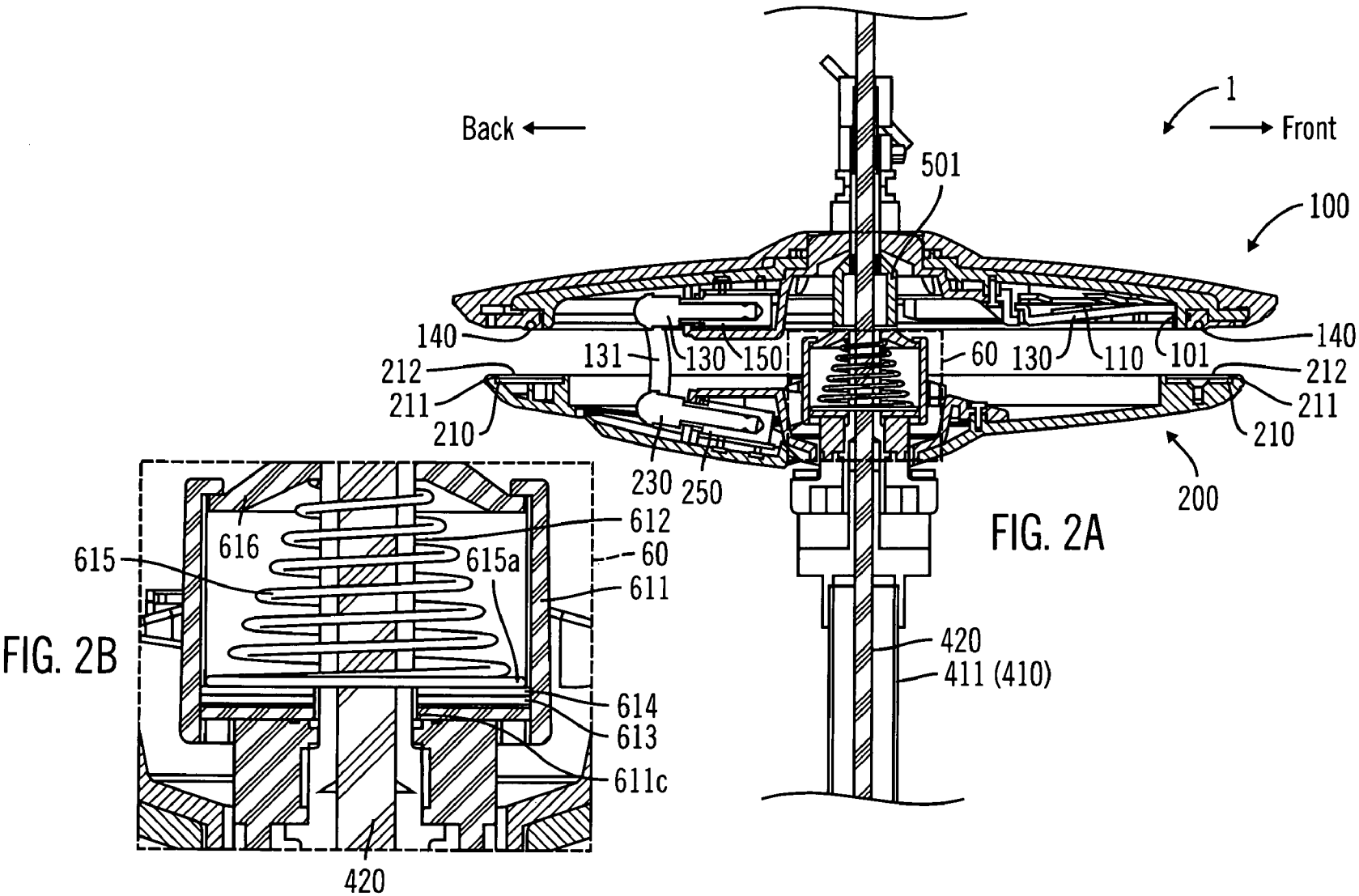
FIGS. 2(*a*) and (*b*) are drawings for an explanation of a displacement sensor, wherein FIG. 2(*a*) is an expanded cross-section drawing of the upper cymbal and the lower cymbal portions of the electronic percussion instrument that is shown in FIG. 1, and FIG. 2(*b*) is a drawing in which the displacement sensor portion in (a) has been further expanded.

Next, an explanation will be given regarding the displacement sensor 60 for the detection of the displacement of the upper cymbal 100, which varies in conformance with the amount that the pedal 440 is stepped on, in the electronic percussion instrument 1 of an embodiment while referring to FIG. 2. FIG. 2(*a*) is an expanded cross-section drawing of the upper cymbal 100 and the lower cymbal 200 in the electronic percussion instrument 1 that is shown in FIG. 1, and FIG. 2(*b*) is a drawing in which the displacement sensor 60 portion in FIG. 2(*a*) is expanded further.

The displacement sensor 60 is, as is shown in FIG. 2(*a*), arranged between the upper cymbal 100 and the lower cymbal 200. The displacement sensor 60 is, as is shown in FIG. 2(*b*), configured comprising a case 611, a circular sensor sheet 613, a cushion sheet 614, a cone shaped coil spring 615, and a cover section 616. The case 611 in the illustrated embodiment comprises a hollow cylinder that is opened on the upper surface. The circular sensor sheet 613 is housed in the bottom section on the inside of the case 611. The cushion sheet 614 is arranged above the sensor sheet 613 and has roughly the same shape as the sensor sheet 613. The cone shaped coil spring 615 is arranged above the cushion sheet 614 and moves downward from the top and spreads. The cover section 616 has a convex shape pointing toward the top and is in contact with the upper section of the coil spring 615.

In addition, an opening section 611*c* is disposed in the center of the lower surface of the case 611 and the opening section 611*c* is a portion of a pass-through hole that passes through the displacement sensor 60 from top to bottom. Opening sections that become portions of the pass-through hole are also disposed in the respective centers of the members, the sensor sheet 613, the cushion sheet 614, and the cover section 616. A sleeve 612 for the insertion through of the extension rod 420 is inserted through each of the opening sections including the opening section 611*c* as well as the center of the coil spring 615.

The explanation will again refer to FIG. 2(*a*). In the electronic percussion instrument 1 of an embodiment, when the pedal 440 is stepped on, the space between the upper cymbal 100 and the lower cymbal 200 moves in a gradually closing direction in conformance with the amount of the stepping. At that time, the rotation stopping member 501 that is fixed to the extension rod 420 also is lowered together with the extension rod, which is lowered by stepping on the pedal. When the rotation stopping member 501 is lowered, the cover section 616 that is in contact with the bottom of the rotation stopping member 501 is pressed downward. As a result, the coil spring 615 is pressed against the cushion sheet 614 and compressed, changing shape in the vertical direction due to the compression force.

The change in shape in the coil spring 615 that is produced in this manner with the compression in the vertical direction is detected electrically using the sensor sheet section 613 and the amount that the pedal is stepped on, in other words, the amount of displacement of the upper cymbal 100, is detected.

The sensor sheet section 613 is configured comprising a printed resistance sheet material (not shown in the drawing) and a printed carbon base plate (not shown in the drawing). In order to simplify the drawing, the sensor sheet section 613 is shown as a single member. The printed resistance sheet has a surface that has been uniformly printed with conductive ink. The printed carbon base plate has two independent specified electrode patterns and terminals. The printed carbon base plate is arranged on the bottom surface of the case 611 and has an electrode pattern on the top. The printed resistance sheet member is arranged above the carbon electrode base plate and has the printed surface of conductive ink facing the carbon electrode base plate.

When the coil spring 615 is compressed and changes shape because of the stepping on the pedal 440, the wider section 615*a* of the coil spring 615, which has a conical shape, presses on the printed resistance sheet material of the sensor sheet section 613 with the interposition of the cushion sheet 614; and because of this, a portion of the printed resistance sheet material is pressed onto the printed carbon base plate. As a result, the conductive ink on the printed resistance sheet material comes into contact with the electrode pattern of the printed carbon base plate and the electrical resistance value of the printed carbon base plate changes.

The electrical resistance value changes in conformance with the compression and change in shape of the coil spring 615, in other words, the amount of displacement of the upper cymbal 100 due to the stepping on the pedal 440. Specifically, when the amount of compression and change in shape of the coil spring 615 becomes greater, the area of the flat portion that is formed by the wire material from the wider section 615*a* of the coil spring 615 up to the portion that has been pressed in conformance with the compression force increases. When the area of the flat portion that is formed by the wire material increases, the conductive ink region on the printed resistance sheet material that comes into contact with the electrode pattern of the printed carbon base plate increases. As a result, the electrical resistance value of the current that flows in the printed carbon base plate decreases. Therefore, the electrical resistance value is detected, and the amount of displacement of the upper cymbal 100 is detected by the numeric digitization of the resistance value.

For the cushion sheet 614, a material having elasticity such as rubber and the like is used. Because of this, when, for example, a pressing force is applied on a single point on the surface of the cushion sheet 614, the pressing force is expanded and transmitted through to the area surrounding the point to which the force is applied.

When the coil spring 615 is pressed onto the sensor sheet section 613 with the interposition of the cushion sheet 614, the portion that is pressed in a helical form by the wire material of the coil spring 615 is made homogeneous. The homogeneous pressing force is transmitted to the sensor sheet section 613. Therefore, since the sensor sheet section 613 can detect the size of the compression and change in shape of the coil spring 615 with sensitivity, the amount of displacement of the upper cymbal 100 can be detected accurately. In addition, since it is set up such that the wider section 615*a* of the conical shaped coil spring 615 is on the bottom, the stability is good and it is possible to detect the size of the compression and change in shape of the coil spring 615 with sensitivity by means of the sensor sheet section 613.

Next, an explanation will be given regarding the vibration sensor 70 in the electronic percussion instrument 1 of an embodiment, with which the vibration of the upper cymbal 100 is detected, while referring to FIG. 3(*a*).

Figure 3A:
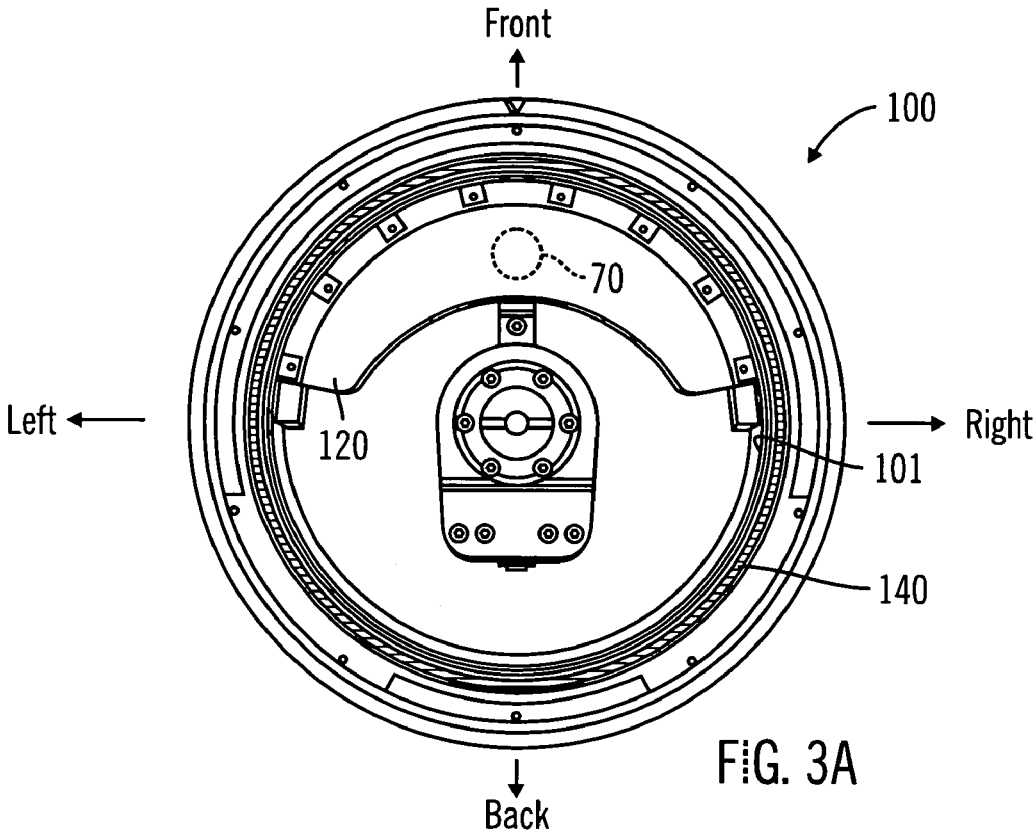
FIG. 3(*a*) shows a rear view of an upper cymbal in an electronic percussion instrument of an embodiment and FIG. 3(*b*) is a rear surface drawing of a lower cymbal in an electronic percussion instrument of an embodiment.
Figure 3B:
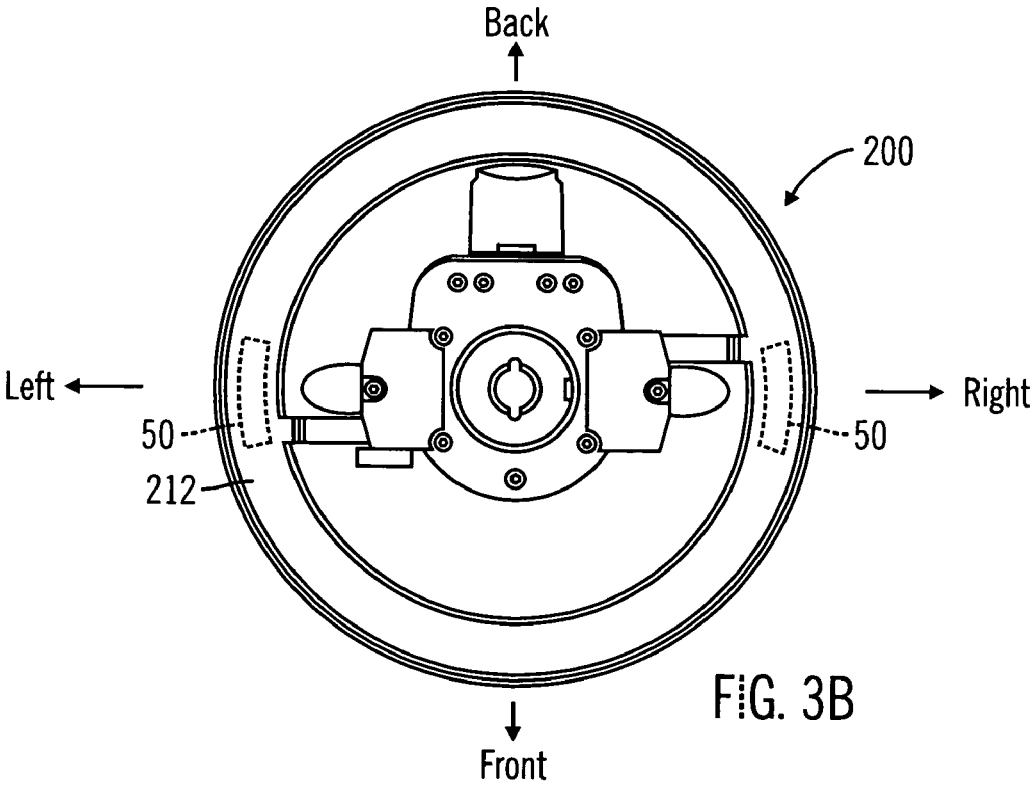

FIG. 3(*a*) shows a rear view of the upper cymbal 100 in the electronic percussion instrument 1. In FIG. 3(*a*), in order to simplify the drawing, members such as the extension rod 420 and the like are partially omitted from the drawing representation. In this specification, the "rear surface of the upper cymbal 100" means the surface that faces the lower cymbal 200 in the electronic percussion instrument 1. In addition, in FIG. 3(*a*), the top of the page is made the "front side" of the upper cymbal 100, the bottom of the page is made the "back side" of the upper cymbal 100, the right side of the page is made the "right side" of the upper cymbal 100, and the left side of the page is made the "left side" of the upper cymbal 100.

As is shown in FIG. 3(*a*), the plate shaped vibration sensor attachment frame 120 has an outer periphery that follows along the inner peripheral wall 101 of the frame that configures the upper cymbal 100. The frame 120 is arranged in the front side semicircle of the upper cymbal 100. A space is formed between the vibration sensor attachment frame 120 and the upper cymbal 100 (refer to FIG. 2). The vibration sensor 70 is disposed on the surface of the vibration sensor attachment frame 120 that faces this space (in other words, the surface on the reverse side of the page of the vibration sensor attachment frame 120 that is shown in FIG. 3(*a*)).

The vibration sensor 70 is a sensor that detects the vibration of the upper cymbal 100 due to the striking of the upper cymbal 100 or the coming into contact of the upper cymbal 100 and the lower cymbal 200 and is, for example, a piezoelectric sensor. When the vibration sensor 70 detects vibration, an electrical signal is transmitted by means of wiring that is not shown in the drawing to the stereo jack 150 (refer to FIG. 2) for link output. This electrical signal is then further input to the stereo jack 250 for link input on the lower cymbal 200 via a plug 130, a cable 131, and a plug 230 and output to a CPU (the CPU 10 that will be discussed later) from an output terminal that is not shown in the drawing. Then, in those cases where the electrical signal is determined to have exceeded a specified value, the signal is processed in the CPU as a vibration for which sound should be produced having been detected.

Figure 4:
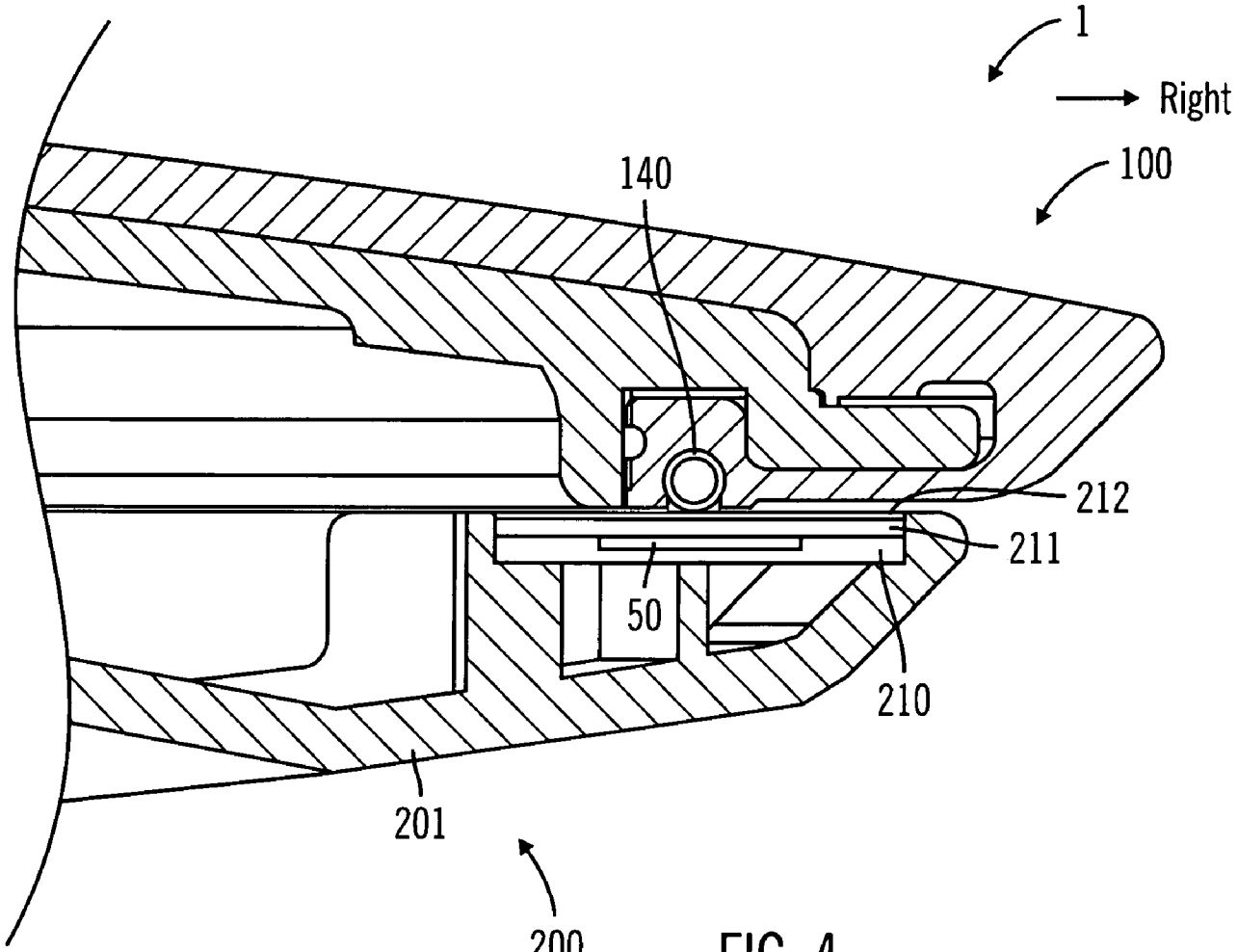
FIG. 4 is an expanded cross-section drawing of a portion of an electronic percussion instrument of an embodiment that includes position switches.

Next, an explanation will be given regarding the position switch 50, with which a state in which the space between the upper cymbal 100 and the lower cymbal 200 has been closed (a closed state) has been detected, while referring to FIG. 3(*b*) and FIG. 4. FIG. 3(*b*) is a rear surface drawing of the lower cymbal 200 in the electronic percussion instrument 1, and FIG. 4 is an expanded cross-section drawing of the portion of the electronic percussion instrument 1 of an embodiment that includes the position switch 50. In FIG. 3(*b*), in order to simplify the drawing, such members as the extension rod 420, the displacement sensor 60, and the like have been partially omitted in the drawing representation. In this Specification, "the rear surface of the lower cymbal 200" means the surface that faces the upper cymbal 100 in the electronic percussion instrument 1. In addition, in FIG. 3(*b*), the top of the page is made the "back side" of the lower cymbal 200, the bottom of the page is made the "front side" of the lower cymbal 200, the right side of the page is made the "right side" of the lower cymbal 200, and the left side of the page is made the "left side" of the lower cymbal 200.

As is shown in FIG. 3(*b*), a pair of position switches 50 are disposed to the left and right in the outer peripheral section of the lower cymbal 200. The position switches 50 are, as is shown in FIG. 4, arranged between the metal plate 210 and the cushion sheet 211 made of rubber that has been disposed below the polyester film 212.

The position switches 50 may be, for example, film type pressure sensitive sensors. When the upper cymbal 100 and the lower cymbal 200 are closed by the stepping operation of the pedal 440, the position switch 50 is pressed by the nylon tube 140 that is disposed on the upper cymbal. When the position switch 50 detects the pressing, an electrical signal is transmitted from an output terminal that is not shown in the drawing to a CPU (the CPU 10 that will be discussed later) by wiring that is not shown in the drawing.

When the upper cymbal 100 is struck, the upper cymbal 100 swings. As a result, a situation can often be produced in which only one of the position switches 50 on one side or the other is pressed by the nylon tube 140 when the upper cymbal 100 is struck. If there is only one position switch 50, it may incorrectly detect a closed state in such a situation. Accordingly, it is preferable that a pair of position switches 50 be disposed on the left and the right of the lower cymbal 200 from the standpoint of detecting a closed state.

In addition, the nylon tube 140 that presses the position switches 50 has, as is shown in FIG. 4, a cross-section that is roughly circular. Because of this, since the area that comes in contact with the position switch 50 can be kept small, the position switch 50 is pressed efficiently. In addition, the nylon tube 140 can slide on the polyester film 212 when the tube presses the position switch 50. Therefore, even when the upper cymbal 100 and the lower cymbal 200 swing, the nylon tube 140 can slide on the polyester film 212 in conformance with the swinging without a change in the pressing state on the position switch 50.

Figure 5:
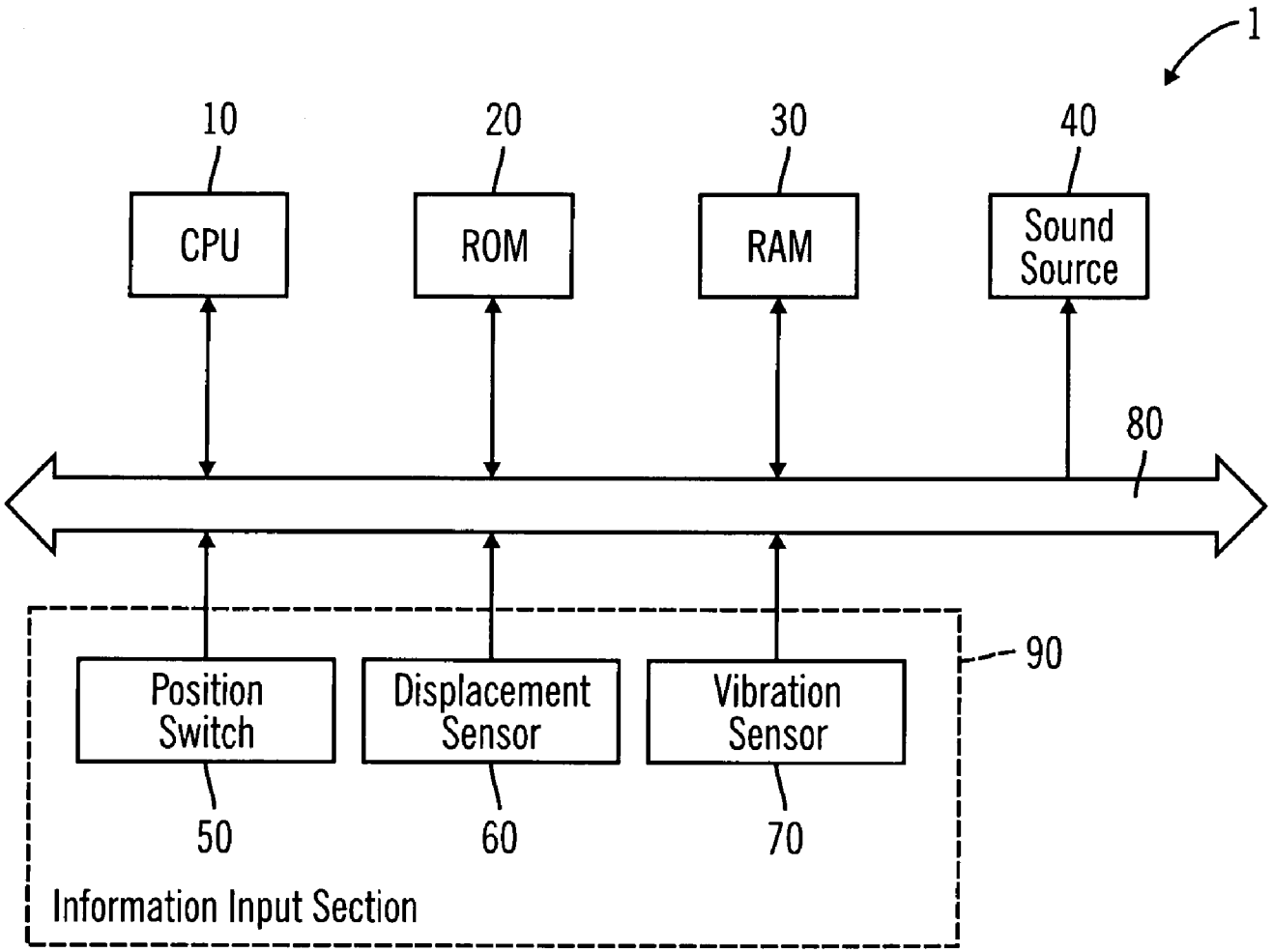
FIG. 5 is a block diagram that shows a configuration of an electronic percussion instrument of an embodiment.

FIG. 5 is a block diagram that shows a configuration of the electronic percussion instrument 1 of an embodiment. The electronic percussion instrument 1 primarily has the CPU 10, the ROM 20, the RAM 30, the sound source 40, the data input section 90 and the bus line 80, with which these structures are interconnected.

The CPU 10 is a central processing unit that controls the entire electronic percussion instrument 1, and the ROM 20 stores the various control programs that are executed by the CPU 10 and the fixed data values that are referred to at the time of execution. Programs for executing processes, such as those shown by the flowcharts in FIG. 9 through FIG. 11, which will be discussed later, may be stored in the ROM 20. Also, functions for obtaining musical tone control values from the output values of the displacement sensor 60 (displacement sensor values), and the like may be stored in the ROM 20.

The RAM 30 is a rewritable memory that can be accessed randomly and that has working areas in which the various register groups that are needed by the control programs that are executed by the CPU 10 are set. The RAM 30 also has temporary areas in which the data that are stored temporarily during processing are stored and the like. The regions in which the offset values that have been set in the offset setting processing, which will be discussed later (FIG. 9), are stored, are provided in the RAM 30. In addition, the regions in which the musical tone control values that have been obtained based on the position sensor values and the various flags that are used in each of the processes are stored, are provided in the RAM 30.

The sound source 40 is something with which digital musical tones are generated based on the musical tone control values when a valid vibration for which a sound should be produced has been detected by the vibration sensor 70 as the trigger signal. The sound source 40 has a waveform ROM that is not shown in the drawing, and the waveform data for five types of hi-hat sounds (open sound, half open sound, slightly open sound, closed sound, and tightly closed sound) are stored in the waveform ROM.

The data input section 90 is configured comprising the position switches 50, the displacement sensor 60, and the vibration sensor 70. The position switches 50 detect a closed position. The displacement sensor 60 detects the amount that the pedal 440 has been stepped on or the amount of displacement of the upper cymbal 100 that corresponds to the amount that pedal 440 is stepped on. The vibration sensor 70 detects whether or not the upper cymbal 100 has been struck. The data input section 90 allows for the input of an "on" signal that indicates the closed position that is detected by the position switches 50 (the standard position information), the displacement sensor value that is detected by the displacement sensor (the position information), and the valid vibration at which sound should be produced that is detected by the vibration sensor 70 (the vibration information).

Figure 6:
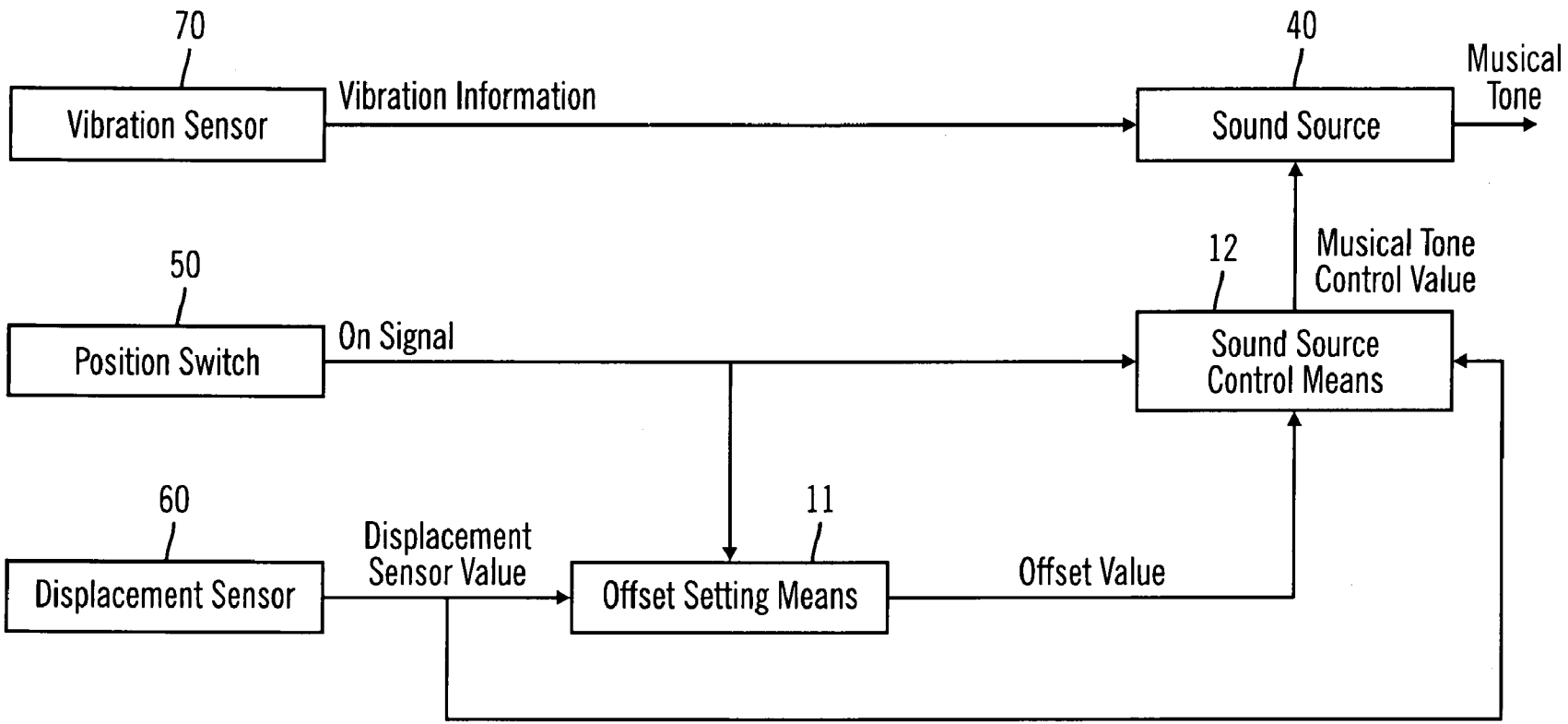
FIG. 6 is a block diagram that shows an overview of an embodiment conceptually.

Next, an explanation of an overview of an embodiment will be given while referring to FIG. 6. FIG. 6 is a block diagram that shows conceptually main portions of an embodiment of an electronic percussion instrument 1 that has been configured as described above.

The vibration sensor 70 that is disposed in the electronic percussion instrument 1 outputs the vibration information to the sound source 40 in those cases where a valid vibration, that exceeds a specified value, has been detected. When a valid vibration is detected, a sound is produced for the vibration. The vibration may be due to the striking of the upper cymbal 100 or due to the contact between the upper cymbal 100 and the lower cymbal 200.

The position switches 50 that are disposed in the electronic percussion instrument 1 output an "on" signal to the offset setting means 11 in those cases where the upper cymbal 100 and the lower cymbal 200 are in a state that is closed (a closed state). The boundary at which the "on" signal becomes "on" from "off" or the boundary at which the signal becomes "off" from "on" is equivalent to where the position relationship between the upper cymbal 100 and the lower cymbal 200 is a closed position (the standard position).

The displacement sensor 60 that is disposed in the electronic percussion instrument 1 outputs the displacement value (the position information) to the offset setting means 11 and, together with this, outputs the value to the sound source control means 12.

The offset setting means 11 acquires the offset value, for obtaining the musical tone control value, from the closed position that is detected based on the on-off timing of the "on" signal that is input from the position switch 50 and the displacement sensor value that has been input from the displacement sensor 60. The offset setting means 11 outputs the offset value to the sound source control means 12.

The sound source control means 12 acquires the musical tone control value based on the displacement sensor value that has been input from the displacement sensor 60, the "on" signal from the position switch 50, and the offset value from the offset setting means 11. The sound source control means 12 outputs the musical tone control value to the sound source 40.

When the vibration information is input from the vibration sensor 70, the sound source 40 begins the generation of a musical tone having a timbre that is based on the musical tone control value that has been input from the sound source control means 12. In addition, when a musical tone control value is input from the sound source control means 12 during the musical tone generation, control of the musical tone during the generation is carried out based on the musical tone control value.

Figure 7:
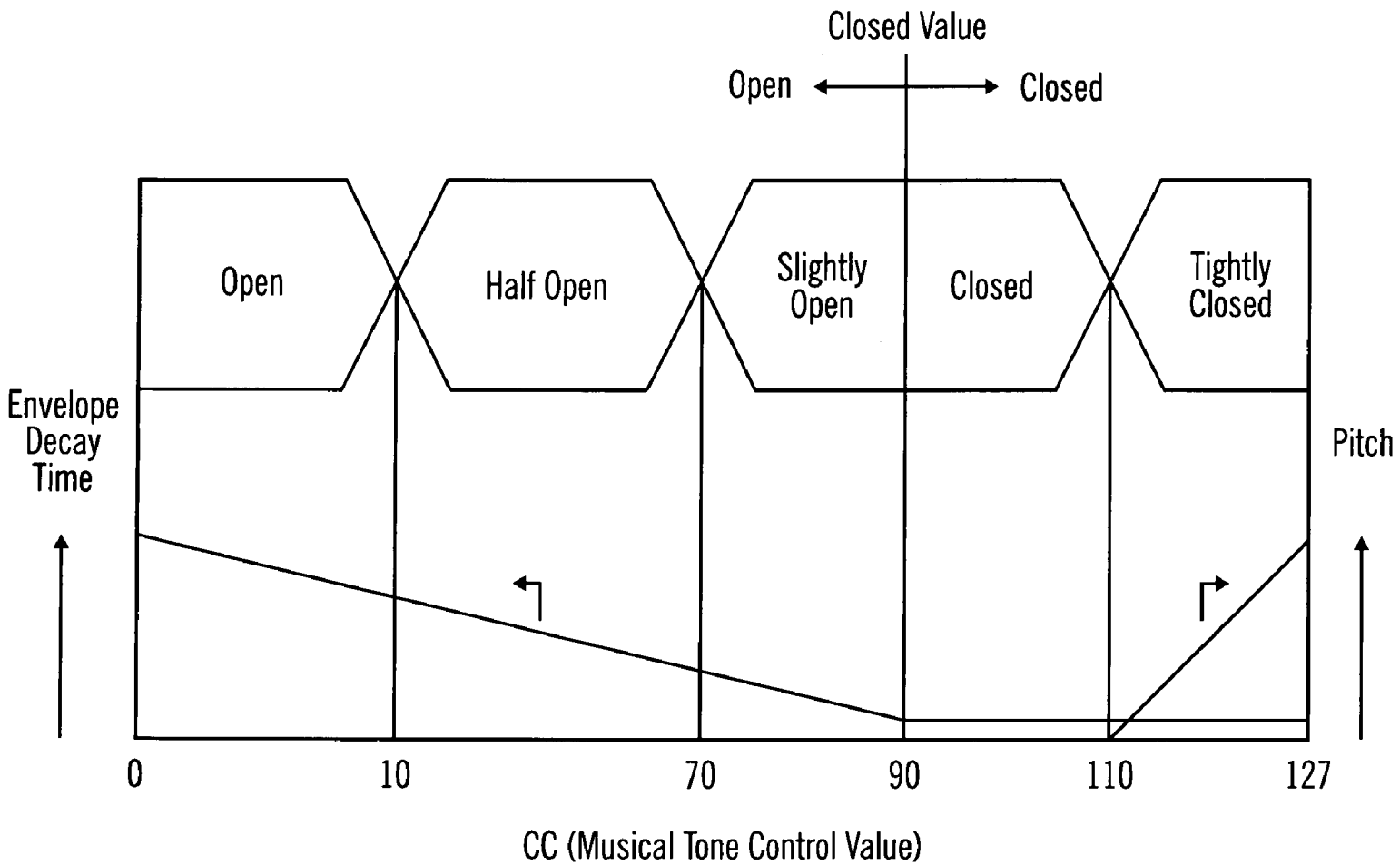
FIG. 7 is a drawing for an explanation of a relationship between musical tone control values that correspond to five types of hi-hat sounds and an envelope and pitch.

Next, an explanation will be given regarding the relationship between the musical tone control value (CC) and the timbre while referring to FIG. 7. FIG. 7 is a drawing for an explanation of a relationship between the musical tone control values that correspond to the five types of hi-hat sounds and the envelope and pitch.

The musical tone control values are the values of MIDI control change (CC) that are expressed by a total of the 128 integers from "0" to "127". The five types of hi-hat sounds (open sound, half open sound, slightly open sound, closed sound, and tightly closed sound) are designated in conformance with those integers.

The musical tone control value "90" is designated as the musical tone control value of the closed position (hereinafter, this musical tone control value will be referred to as the "closed value"). With this value as the boundary, the musical tone control values "0" through "89" are designated as ones that correspond to a state in which the upper cymbal 100 and the lower cymbal 200 are separated (hereinafter, this state will be referred to as the "open state"). On the other hand, the musical tone control values "90" through "127" are designated as ones that correspond to a state in which the upper cymbal 100 and the lower cymbal 200 are joined tightly (hereinafter, this state will be referred to as the "closed state").

The musical tone control values "0" through "89" that correspond to the open state are demarcated by three timbres. Specifically, as is shown in FIG. 7, the timbre changes in the order, open sound, half open sound, and slightly open sound from the "0" side. In this case, the timbre changes from an open sound to a half open sound with the musical tone control value of "10" as the boundary while the timbre cross fades and, in addition, changes from a half open sound to a slightly open sound with the musical tone control value of "70" as the boundary while the timbre cross fades.

At the musical tone control value of "90" that corresponds to the closed position, as is shown in FIG. 7, the timbre switches from a closed sound to a slightly open sound or from a slightly open sound to a closed sound with this value as a boundary.

The musical tone control values of "90" through "127" that correspond to the closed state are demarcated by two timbres. Specifically, as is shown in FIG. 7, the timbre changes in the order, closed sound and tightly closed sound, from the "90" side. In this case, the timbre changes from the closed sound to the tightly closed sound with the musical tone control value "110" as the boundary while the timbre cross fades.

The musical tone envelope and pitch are controlled in conformance with the musical tone control value. As is shown in FIG. 7, for the envelope that is controlled, in an open state, the decay time gradually becomes shorter in accordance with the increase in the musical tone control value, and the closed state is constant. On the other hand, the control of the pitch is carried out only for the tightly closed sound.

Figure 8:
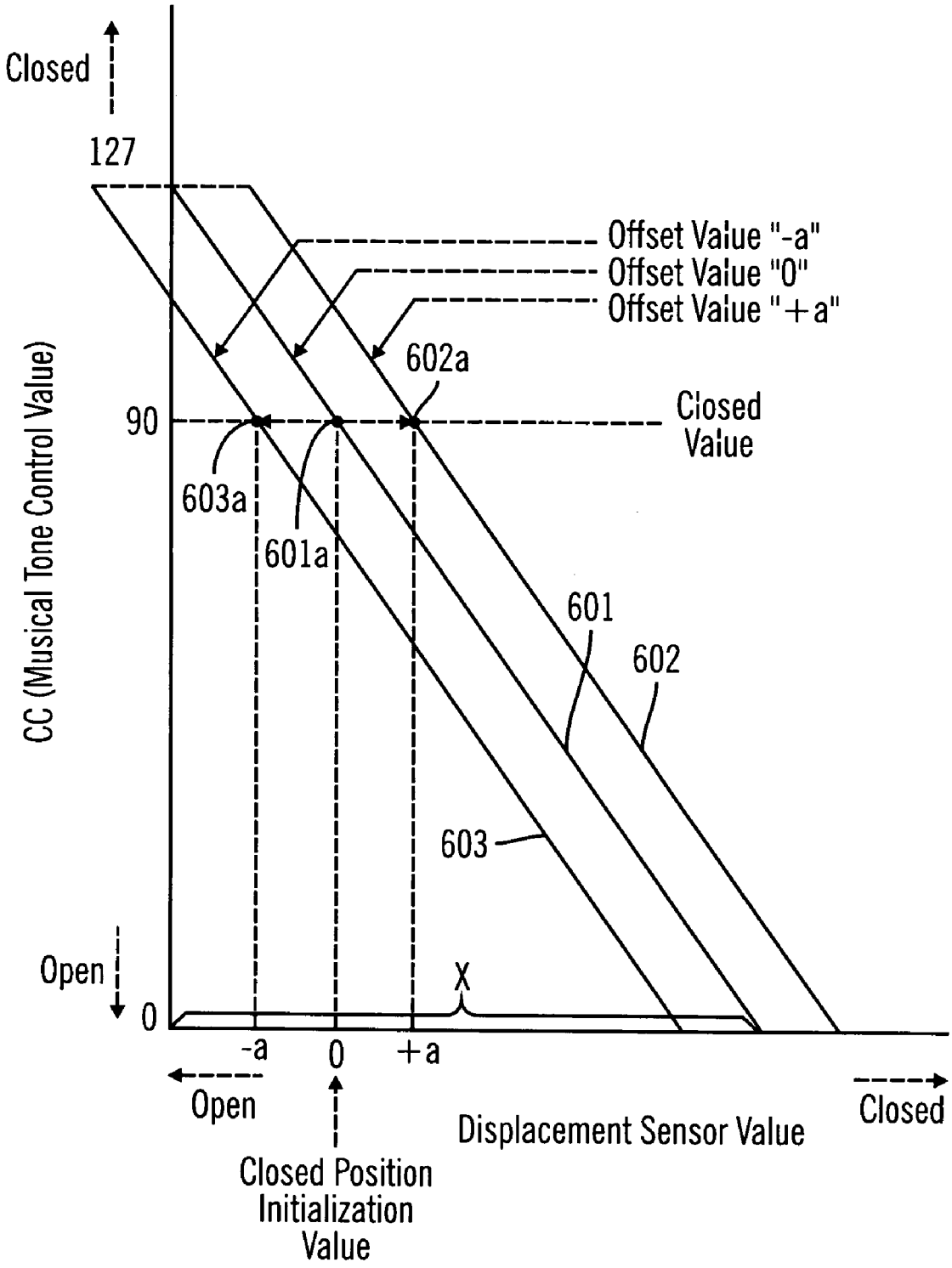
FIG. 8 is a drawing that shows a correlation between a displacement sensor value and a musical tone control value in an electronic percussion instrument of an embodiment.

Next, an explanation will be given regarding an overview of processing for obtaining the musical tone control value in the electronic percussion instrument 1 of an embodiment from the output value of the displacement sensor 60 (the displacement sensor value). The displacement sensor value may change in conformance with the amount that the pedal 440 is stepped on or may change in conformance with the amount of displacement of the upper cymbal 100 that corresponds to the amount that the pedal 440 is stepped on. FIG. 8 is a drawing that shows the correlation between the displacement value and the musical tone control value (CC).

As is shown in FIG. 8, a linear function is established between the displacement sensor and the musical tone control value, and it is possible to transform the displacement value that has been detected into the musical tone control value by means of computation based on the function.

The straight line 601 that is shown in FIG. 8 is an initial function that is stored in the ROM 20 of the electronic percussion instrument 1. With the initial function, the musical tone control values "0" through "127" are coordinated with the output range "X" of the displacement sensor values.

The closed position initialization value is the value that is initially set for the displacement sensor value that corresponds to the closed position. This closed position initialization value is suitably adjusted so as to become "0" for the closed position by means of the calibration mode of the electronic percussion instrument 1 prior to the performance and is stored in a specified storage region of the RAM 30. When the power is turned on, the value that was set at the time of the previous operation is read out and used.

At the time that the closed position initialization value is "0," the straight line 601 that is shown in FIG. 8 is a function that passes through the point 601*a* (coordinates (0, 90)), which is where the musical tone control value is the "90" that corresponds to the closed value. The straight line 601, which is the initial function, is expressed by the following equation as a variable of the displacement sensor value and the musical tone control value (CC):

$$CC=A\times(\text{displacement sensor value}-\text{closed position initialization value})+90 \quad \text{(Equation 1).}$$

Here, "A" is a specified value that expresses the slope of the straight line 601.

However, it should be noted that since the closed position initialization value is set at "0," the equation described above can be expressed as "CC=A×displacement sensor value+90."

The detailed processing will be discussed later, but for a closed position that has actually been detected by the position switches 50 during the performance (hereinafter, this position will be referred to as the "physically closed position"), the following occurs. In those cases where the displacement sensor value that has been output from the displacement sensor 60 has been displaced the amount of +α from the "0," which is the closed position initialization value, the musical tone control value is acquired using the straight line 602. The straight line 602 is parallel to the initial function 601 and passes through the point 602*a* (coordinates (+α, 90)).

On the other hand, in those cases where, for the physically closed position, the displacement sensor value that has been detected from the displacement sensor 60 has been displaced the amount of −α from the "0," which is the closed position initialization value, the musical tone control value is acquired using the straight line 603. The straight line 603 is parallel to the initial function 601 and passes through the point 603*a* (coordinates (−α, 90)).

As described above, with the electronic percussion instrument 1 of an embodiment, since the musical tone control value is obtained based on the function that has shifted parallel to the initial function (the straight line 601) in conformance with the shift of the physically closed position, it is possible to prevent the occurrence of a dead zone, which has been a problem with electronic percussion instruments of the past. Therefore, it is possible to generate an appropriate musical tone in conformance with the actual amount of displacement of the pedal without the existence of errors due to the variations in the displacement sensor values that are output from the displacement sensor 60.

Figure 9:
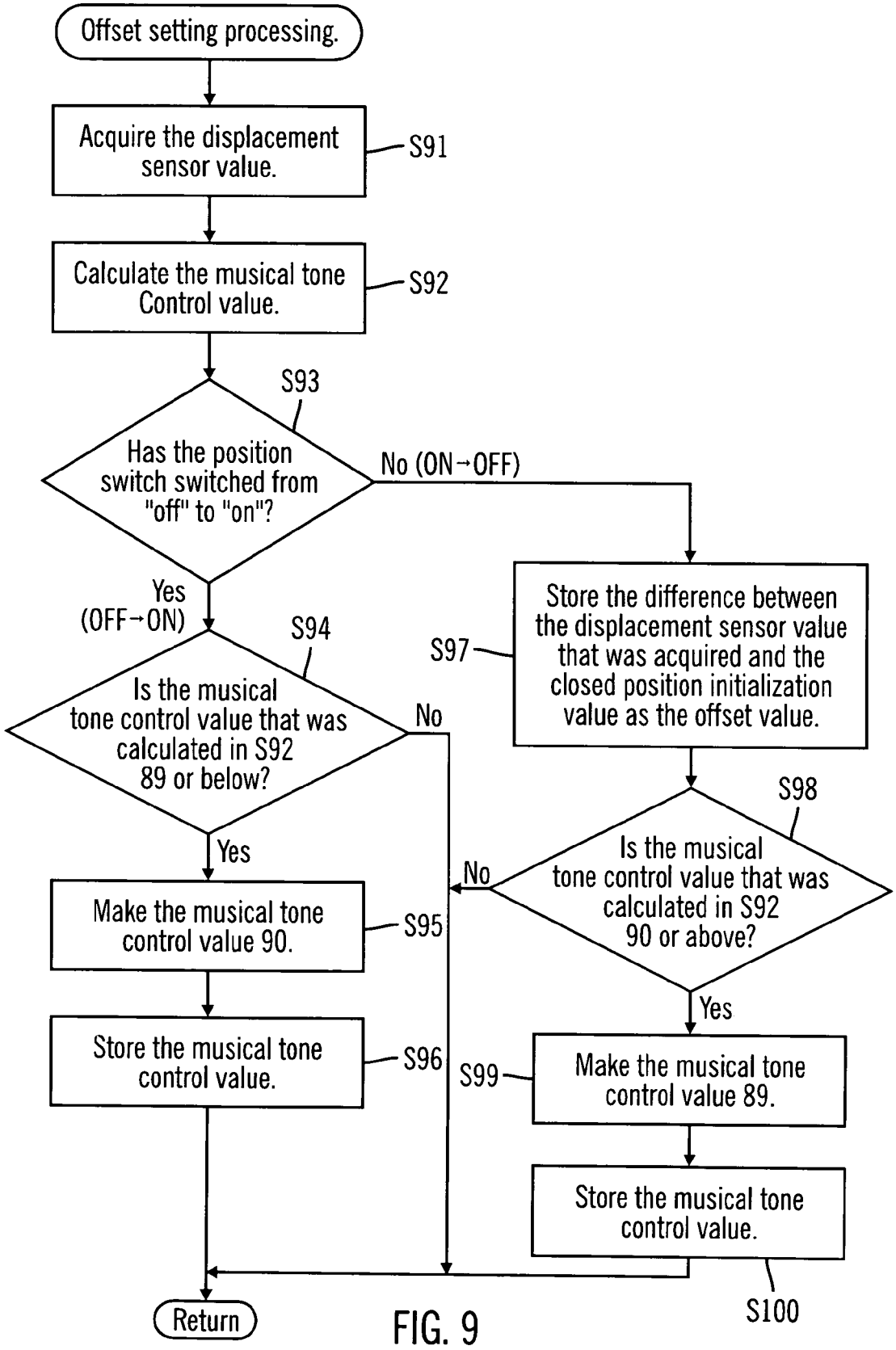
FIG. 9 is a flowchart of offset setting processing that is executed by a CPU of an electronic percussion instrument of an embodiment.

An explanation will be given below regarding each of the processes for the generation of an appropriate musical tone in the electronic percussion instrument 1 that has been configured as described above, taking into account the physically closed position, while referring to FIG. 9 through FIG. 11. FIG. 9 is a flowchart of offset setting processing that is executed by the CPU 10 of the electronic percussion instrument 1.

With the offset setting processing, for each switching to "on" or "off" by the position switch 50, in other words, for each time that the electronic percussion instrument 1 reaches the closed position, processing is carried out to set the offset value in order to correct the initial function and the like.

The offset setting processing is launched for each switching of the position switch 50 from "off" to "on" or from "on" to "off". First, the displacement sensor value that is output from the displacement sensor 60 is acquired (S91), and the musical tone control value (CC) is calculated using this displacement sensor value (S92).

In the processing of S92, the musical tone control value (CC) is calculated by means of the following equation:

$$CC=A\times(\text{displacement sensor value}-\text{closed position initialization value}+\text{offset value})+90 \quad \text{(Equation 2).}$$

"A" is the slope of the straight line 601, which is the initial function (refer to FIG. 6). The closed position initialization value is set in this embodiment to "0" as described above.

In addition, the offset value is the value that is set in S97, which will be discussed later, and is a value for the correction of the error between the closed position initialization value and the displacement sensor value that is detected in the physically closed position. The closed position initialization value is set by either the initialization when the power is turned on or by the adjustment in the calibration mode. The offset value is stored in a specified region of the RAM 30 and is set to "0" by the setting of the closed position initialization value by turning the power on or by executing the calibration mode and the like. The value is updated by the execution of the processing of S97 which will be discussed later.

After the processing of S92, whether or not the offset setting processing has been launched due to the fact that the position switch 50 has been switched from "off" to "on" is detected (S93). If the result that has been ascertained by the processing of S93 is that the launching is due to the fact that the position switch 50 has switched from "off" to "on" (S93: yes), whether or not the musical tone control value that has been calculated in S92 is "89" or below, in other words, whether or not the musical tone control value that has been calculated in S92 is a value that corresponds to the open state in the electronic percussion instrument 1 ("0" through "89"), is detected (S94).

If the result that has been ascertained by the processing of S94 is that the musical tone control value that has been calculated by S92 is "89" or below (S94: yes), the musical tone control value is made "90," which is the minimum value for the musical tone control value that corresponds to a closed state (S95). After the processing of S95, the musical tone control value "90" is stored in a specified region of the RAM 30 (S96) and the offset setting processing ends.

In those cases where, despite the fact that a closed state for the electronic percussion instrument 1 has been detected by the position switches 50, the musical tone control value has become "89" or below, which corresponds to an open state, caused by a shift of the physically closed position, the musical tone control value is forced to a setting of "90," which corresponds to the closed state. Therefore, it is possible to prevent a condition in which, despite the fact that the performer has intended to produce a closed state for the electronic percussion instrument 1, contrary to that intention, a musical tone for an open state is generated.

On the other hand, if the result that has been ascertained by the processing of S94 is that the musical tone control value that has been calculated in S92 is "90" or above (S94: no), the processing of S95 through S96 is skipped and the offset setting processing ends.

In addition, if the result that has been ascertained by the processing of S93 is that the launching of the offset processing is due to the fact that the position switches have switched from "on" to "off" (S93: no), the difference between the displacement sensor value that has been obtained by the processing of S91 and the closed position initialization value (this is "0" in this embodiment) is stored in a specified region of the RAM 30.

The offset value is stored in a specified storage region of the RAM 30 by the processing of S97 in order to take into consideration the fluctuations of the physically closed position. Separate from the offset setting processing, the musical tone control value is acquired in the musical tone control value acquisition processing, which is not shown in the drawing, that is launched every specified time period using Equation (2) described above from the most recent offset value that is stored in the specified storage region of the RAM 30 and the displacement sensor value that is acquired at the time of the launching of the musical tone control value acquisition processing. Therefore, since a musical tone control value that has taken into consideration the fluctuations of the physically closed position is always acquired, an appropriate musical tone can always be generated.

For the processing of S97, with which the acquisition of the offset value is carried out, it is preferable that this be executed after the detection of the switching of the position switches 50 from "on" to "off" because the "on" state of the position switches 50 at that point in time of the detection is more stable. Since, for example, because the position switches 50 in this embodiment are pressed with the interposition of the cushion sheet 211 made of rubber, it takes some time from after the start of the detection of the pressing of the nylon tube 140 until the "on" state becomes stable, doing the processing as described above is preferable.

However, the setting of the offset value is not necessarily limited to being executed after the detection of the switching of the position switches 50 from "on" to "off". It may be configured such that the processing is executed after the switching from "off" to "on" has been detected in conformance with the characteristics of the position switch 50, or it may also be configured such that the processing is executed for each switching of the position switch 50 from "on" to "off" or from "off" to "on."

After the processing of S97, whether or not the musical tone control value that was calculated in S92 is "90" or above, in other words, whether the musical tone control value that was calculated in S92 is a value that corresponds to the closed state ("90" through "127") or not is ascertained (S98).

If the result that has been ascertained by the processing of S98 is that the musical tone control value that was calculated in S92 is "90" or above (S98: yes), the musical tone control value is made "89," which is the maximum value of the musical tone control value in the open state (S99). After the processing of S99, the musical tone control value "89" is stored in a specified region of the RAM 30 (S100) and the offset setting processing ends.

By means of the processing of S95, in those cases where, despite the fact that an open state for the electronic percussion instrument 1 has been detected by the position switches 50, the musical tone control value that has been calculated becomes "90" or above, which corresponds to the closed state, caused by a shift in the physically closed position, the musical tone control value is forced to a setting of "89," which corresponds to the open state. Therefore, it is possible to prevent a condition in which, despite the fact that the performer has intended to produce an open state for the electronic percussion instrument 1, contrary to that intention, a musical tone for a closed state is generated.

On the other hand, if the result that has been ascertained by the processing of S98 is that the musical tone control value that was calculated in S92 is "89" or below (S98: no), the processing of S99 through S100 is skipped and the offset setting processing ends.

Figure 10A:
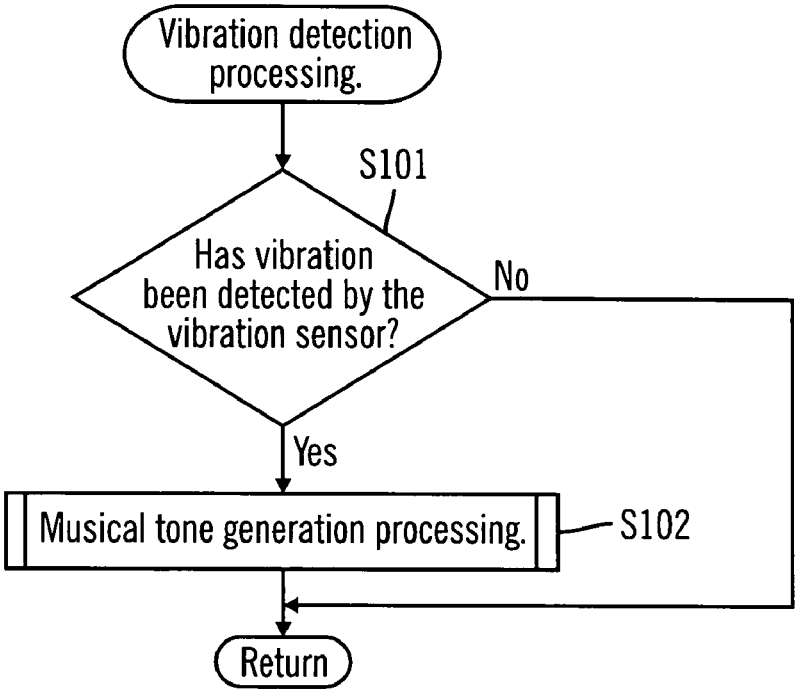
FIG. 10(*a*) is a flowchart of vibration detection processing that is executed by a CPU of an electronic percussion instrument of an embodiment, and FIG. 10(*b*) is a flowchart of a musical tone generation processing portion of the vibration detection processing of FIG. 10(*a*)
Figure 10B:
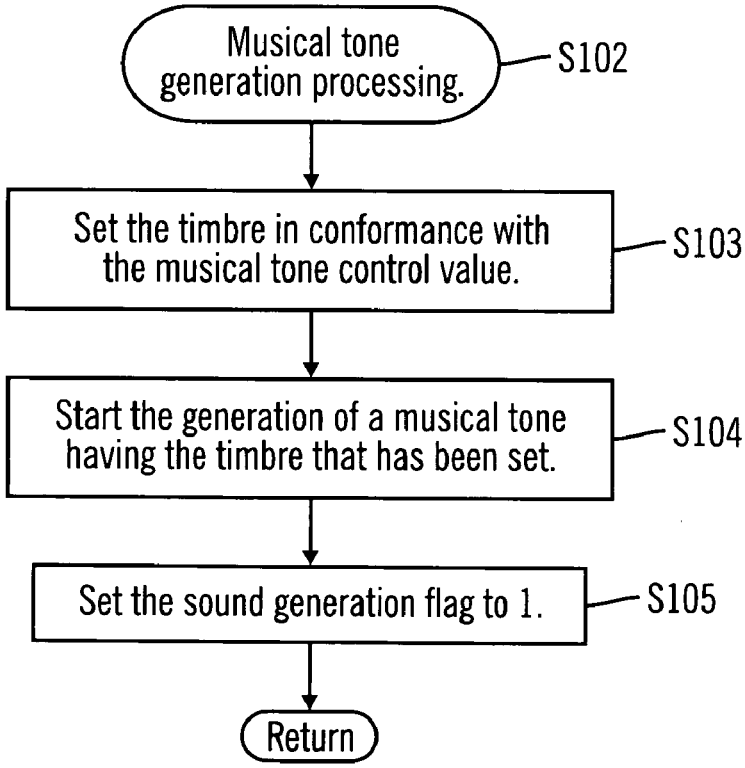

FIG. 10 is a drawing that shows processing with which a musical tone is generated in those cases where a valid vibration due to the striking or contact of the electronic percussion instrument 1 of an embodiment has been detected. FIG. 10(*a*) is a flowchart of vibration detection processing that is executed by the CPU of the electronic percussion instrument 1, and FIG. 10(*b*) is a flowchart of the portion that is musical tone generation processing in the vibration detection processing of FIG. 10(*a*) (S102).

The vibration detection processing that is shown in FIG. 10(*a*) is a timer interrupt routine that is launched each specified period of time (each several msec). When the vibration detection processing is launched, first, whether or not vibration information has been detected by the vibration sensor 70, in other words, whether or not valid vibration, in which a specified value has been exceeded and sound should be generated for the vibration due to the striking of the upper cymbal 100 or the coming into contact of the upper cymbal 100 and the lower cymbal 200, has been detected, is ascertained (S101).

If the result that has been ascertained by the processing of S101 is that there has been no detection of vibration information by the vibration sensor 70 (S101: no), since valid vibration for which sound should be generated has not been detected, the vibration detection processing ends as it is.

On the other hand, if the result that has been ascertained by the processing of S101 is that there has been detection of vibration information by the vibration sensor 70 (S101: yes), the musical tone generation processing (S102), which will be discussed later, is executed and the vibration detection processing ends.

In the musical tone generation processing (S102), first, as is shown in FIG. 10(*b*), the timbre that is in conformance with the most recent musical tone control value, which is stored in the RAM 30, is set in the sound source 40 (S103). Then, the generation of a musical tone at the timbre that has been set in the sound source 40 is started (S104). After the processing of S104, the value of the sound generation flag is made "1" (S105) and the sound generation processing ends. The sound generation flag here is a flag not shown in the drawing that has been disposed in the RAM 30 and has a value of "1" in those cases where a musical tone is being generated in the sound source 40. On the other hand, the flag has a value of "0" in those cases where a musical tone is not produced. The sound generation flag is initialized to "0" when the power is turned on.

Figure 11:
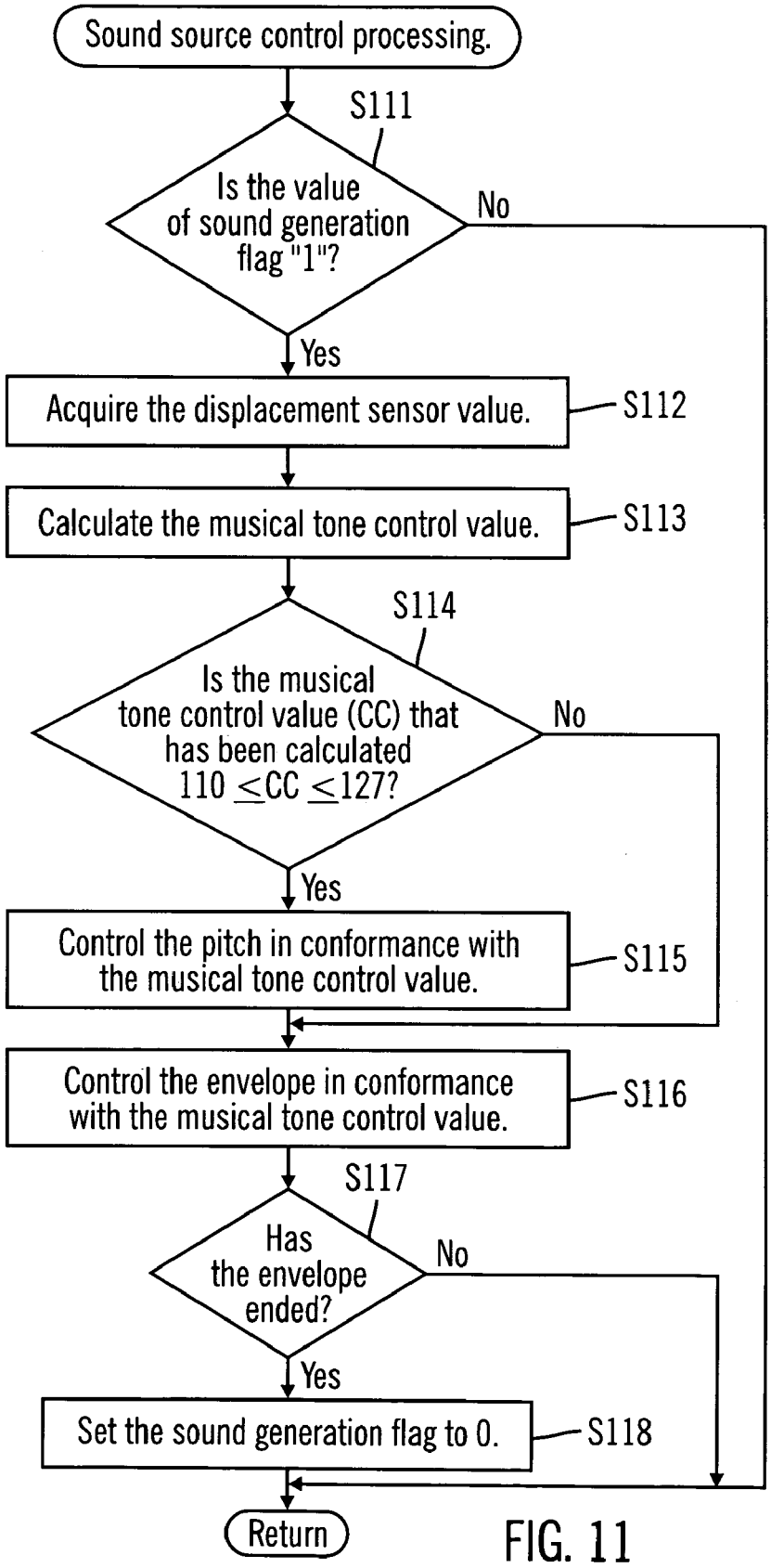
FIG. 11 is a flowchart of musical tone control processing that is executed by a CPU of an electronic percussion instrument of an embodiment.
Figures 12A, 12B, 12C:
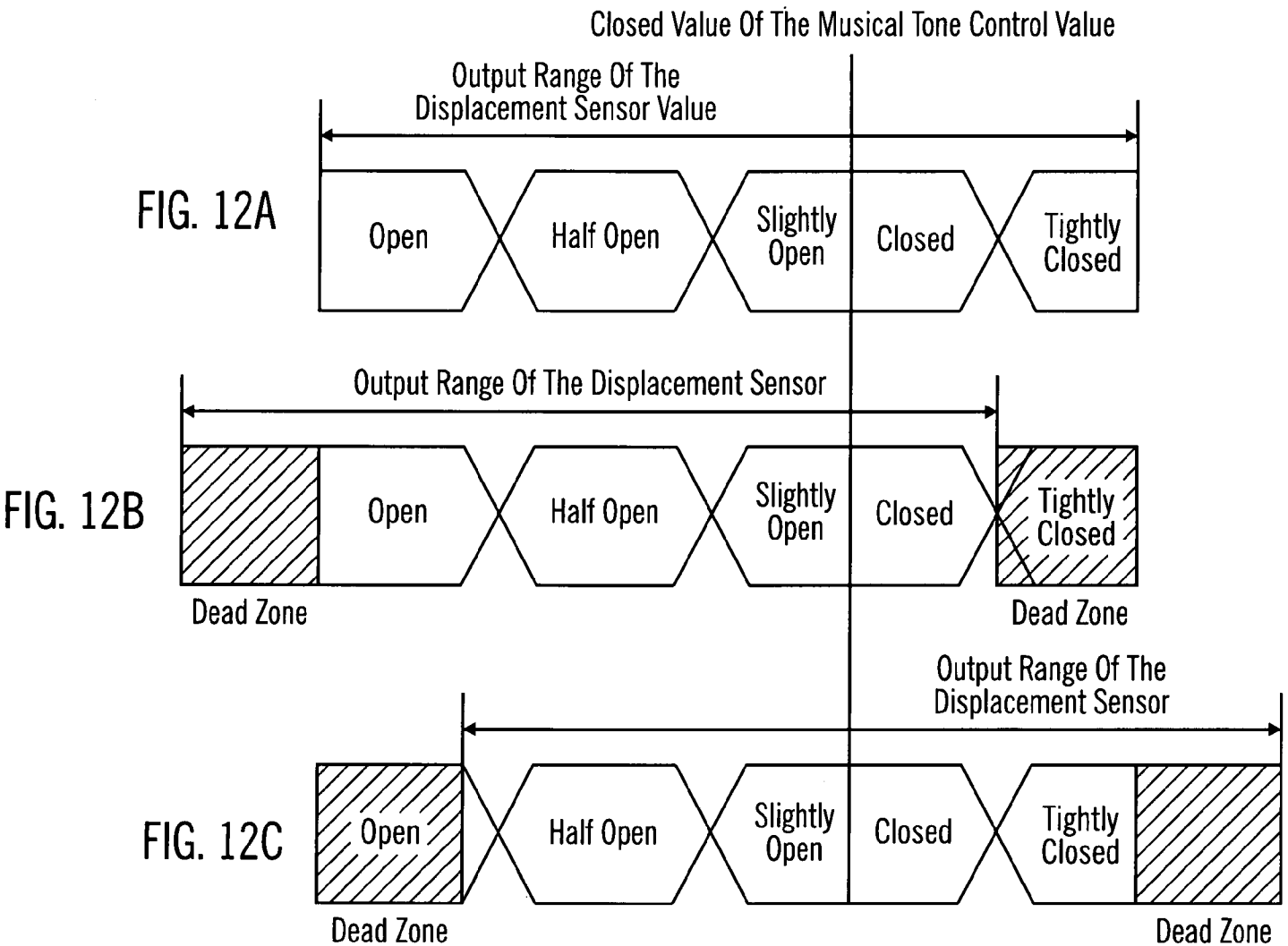
FIG. 12 is a drawing for the explanation of the problems associated with a prior electronic percussion instrument that employs a displacement sensor for the control of the timbre; where FIG. 12(*a*) is a drawing that shows conceptually a relationship between an output range of the displacement sensor values that have been designated in advance, and FIG. 12(*b*) is a drawing that shows conceptually a case where an output range of displacement sensor values that have actually been detected have shifted in the negative direction, and FIG. 12(*c*) is a drawing that shows conceptually a case where an output range of displacement sensor values that have actually been detected have shifted in the positive direction.

FIG. 11 is a flowchart of sound source control processing that is executed by the CPU 10 of the electronic percussion instrument 1. The sound source control processing is a timer routine that is launched at each specified time period (each several msec) and is processing in which, during the generation of a musical tone, the pitch and envelope of the musical tone are controlled in conformance with the displacement sensor value.

When the sound source control processing is launched, first, whether the value of the sound generation flag is "1" or not, in other words, whether or not a musical tone is being generated, is ascertained (S111). If the result that has been ascertained by the processing of S111 is that the value of the sound generation flag is "1" (S111: yes), the displacement sensor value is acquired (S112) and the musical tone control value is calculated based on the value of the displacement sensor that has been acquired (S113). In the processing of S113, the musical tone control value is calculated using Equation (2).

After the processing of S113, whether or not the musical tone control value is 110 or greater and 127 or less ($110 \leqq CC \leqq 127$), in other words, whether the musical tone control value that has been calculated indicates a tightly closed sound (including a closed fade sound) or not is ascertained (S114). If the result that has been ascertained by the processing of S114 is that the musical tone control value that has been calculated is in the range of $110 \leqq CC \leqq 127$ (S114: yes), pitch control of the tightly closed sound is carried out in conformance with the musical tone control value (S115) and, in addition, envelope control of the tightly closed sound is carried out in conformance with the musical tone control value (S116).

On the other hand, if the result that has been ascertained by the processing of S114 is that the musical tone control value that has been calculated is a value that is outside the range of $110 \leqq CC \leqq 127$ (S114: no), since the musical tone for the musical tone control value is something other than a tightly closed sound and there is no need to carry out pitch control, the processing of S115 is skipped and the envelope control of the musical tone is carried out in conformance with the musical tone control value.

By means of the processing of S115 through S116, the envelope control and, especially in the case of a tightly closed sound, the pitch control of the musical tone are executed in conformance with the fluctuations of the displacement sensor value during the musical tone generation. The envelope control and the pitch control are carried out with Equation (2) described above, in other words, with reference to the musical tone control value (CC) in which the physically closed position has been taken into account. As a result, appropriate control of the musical tone is done in conformance with the amount that the pedal 440 has been stepped on or the amount of displacement of the upper cymbal 100 that corresponds to the amount that the pedal 440 has been stepped on.

After the processing of S116, whether or not the envelope of the musical tone has ended during the sound generation is ascertained (S117) and, if it is ascertained that the envelope has ended (S117: yes), the value of the sound generation flag is made "0" (S118) and the sound source control processing ends.

On the other hand, if in the processing of S117, it is not ascertained that the envelope has ended (S117: no), the processing of S118 is skipped and the sound source control processing ends.

In addition, if the result that has been ascertained in the processing of S111 is that the value of the sound generation flag is not "1" (S111: no), since a musical tone is not being generated, all of the processing of S112 through S118 is skipped and the sound source control processing ends.

As described above, in accordance with the electronic percussion instrument 1 of an embodiment, by means of the detection of the switching of the position switches 50 from "on" to "off," for each time that a closed position of the electronic percussion instrument 1 is detected, an offset value with which the closed position initialization value is corrected is acquired based on the displacement sensor value (the value that is output from the displacement sensor 60) at that time. On the other hand, the musical tone control value is acquired based on the closed position initialization value that has been corrected by the displacement sensor value and the offset information with the vibration information that is output due to the detection of a valid vibration, for which a musical tone should be generated, by the vibration sensor 70 as a trigger signal. Therefore, since an offset value that conforms to the fluctuations of the physically closed position is used and a musical tone control value is acquired that uses a closed position initialization value that has always been appropriately corrected, it is possible to always generate an appropriate musical tone without depending on the fluctuations of the physically closed position.

An example of an operation of a correction information storage means is shown by an operation of the RAM 30 and the processing of S97 in the offset setting processing (FIG. 9). An example of an operation of a musical tone generation means is shown by the musical tone generation processing (FIG. 10(*b*)), the sound source control processing (FIG. 11), and an operation of the sound source 40.

In addition, an example of an operation of a musical tone control information acquisition means is shown by the "musical tone control value acquisition processing not shown in the drawing that is launched at each specified time period," the processing of S92 in the offset setting processing (FIG. 9), and the processing of S113 in the sound source control processing (FIG. 11). In addition, an example of an operation of a musical tone control means is shown by the sound source control processing (FIG. 11) and an operation of the sound source 40.

In addition, an example of an operation of a correction information storage means is shown by the processing of S97 in the offset setting processing (FIG. 9) and an operation of the RAM 30.

An explanation was given above of the present invention based on embodiments; however, the present invention is in no way limited to the embodiments described above and the fact that various modifications and changes are possible that do not deviate from and are within the scope of the essentials of the present invention can be easily surmised.

For example, in the embodiments described above, the configuration is such that the displacement sensor 60 is disposed between the upper cymbal 100 and the lower cymbal 200. However, as long as the amount of displacement of the upper cymbal 100 can be detected, that configuration and arrangement location are not a special feature. For example, it may also be configured such that a sensor is disposed that detects the amount that the pedal 440 is stepped on and the amount of the stepping that has been performed is detected.

In addition, in the embodiments described above, the configuration is such that the vibration sensor 70 is arranged on the upper cymbal 100 via the vibration sensor attachment frame 120; but, for example, it may also be configured such that the sensor is arranged directly on the frame portion of the upper cymbal as is cited in Japanese Laid-Open Patent Application Publication (Kokai) Number 2003-167574.

In addition, in the embodiments described above, the function, "CC=A×(displacement sensor value−closed position initialization value+offset value)+90" has been used for the acquisition of the musical tone control value (CC). In other words, the correction of the closed position initialization value that takes into consideration the physically closed position is carried out by subtracting the offset value that has been obtained as a result of the processing of S97 from the closed position initialization value. Instead of this, it may also be configured such that a musical tone control value (CC)' is computed by subtracting the value in which the coefficient "A" has been added to the offset value that as been obtained as described above from the CC that has been obtained by the initial function, "CC=A×(displacement sensor value−closed position initialization value)+90." In other words, it may also be configured such that the musical tone control value is computed as "(CC)'=CC−(A×offset value)."

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An electronic percussion instrument, comprising:

input means with which vibration information, which expresses a vibration of an operator, position information, which expresses a position of the operator, and standard position information, which indicates a standard position of the operator, are input;

correction information storage means with which, when the standard position information is input in the input means, correction information based on the position information that corresponds to the standard position information is stored; and musical tone generation means with which, when the vibration information has been input in the input means, a musical tone is generated in conformance with the position information that has been input in the input means that corresponds to the vibration information that has been input and the correction information that has been stored in the correction information storage means.

2. An electronic percussion instrument, comprising:

input means with which vibration information, which expresses a vibration of an operator, position information, which expresses a position of the operator, and standard position information, which indicates a standard position of the operator, are input;

correction information storage means with which, when the standard position information is input in the input means, correction information based on the position information that corresponds to the standard position information is stored;

musical tone generation means with which, when the vibration information has been input in the input means, a musical tone is generated in conformance with the position information that has been input in the input means that corresponds to the vibration information that has been input and the correction information that has been stored in the correction information storage means; and musical tone control information acquisition means with which musical tone control information is acquired from the position information that corresponds to the vibration information that has been input in the input means based on a specified function;

wherein the musical tone generation means is one that generates the musical tone based on the musical tone control information that has been acquired by the musical tone control information acquisition means.

3. The electronic percussion instrument of claim 1, further comprising:

musical tone control means with which, during the generation of the musical tone by the musical tone generation means, the musical tone is controlled during the generation based on the position information that has been input by the input means and the correction information that has been stored in the correction information storage means.

4. The electronic percussion instrument of claim 2, further comprising:

musical tone control means with which, during the generation of the musical tone by the musical tone generation means, the musical tone is controlled during the generation based on the position information that has been input by the input means and the correction information that has been stored in the correction information storage means.

5. An electronic percussion instrument, comprising:

vibration information detection means with which vibration information that expresses a vibration of an operator is detected;

position information acquisition means with which position information that expresses a position of the operator is acquired;

standard position detection means with which standard position information that indicates the fact that the position of the operator is in a standard position is detected;

correction information storage means with which, when the standard position information is detected by the standard position detection means, the correction information that is based on the position information that corresponds to the standard position that has been detected is stored; and musical tone generation means with which, when the vibration information is detected by the vibration information detection means, a musical tone is generated in conformance with the position information that corresponds to the vibration information that has been detected and the correction information that has been stored in the correction information storage means.

6. An electronic percussion instrument, comprising:

vibration information detection means with which vibration information that expresses a vibration of an operator is detected;

position information acquisition means with which position information that expresses a position of the operator is acquired;

standard position detection means with which standard position information that indicates the fact that the position of the operator is in a standard position is detected;

correction information storage means with which, when the standard position information is detected by the standard position detection means, the correction information that is based on the position information that corresponds to the standard position that has been detected is stored;

musical tone generation means with which, when the vibration information is detected by the vibration information detection means, a musical tone is generated in conformance with the position information that corresponds to the vibration information that has been detected and the correction information that has been stored in the correction information storage means; and musical tone control information acquisition means with which musical tone control information is acquired from the position information that corresponds to the vibration information that has been detected by the vibration detection means based on a specified function;

wherein the musical tone generation means is one in which the musical tone is generated based on the musical tone control information that has been acquired by the musical tone control information acquisition means.

7. The electronic percussion instrument of claim 5, further comprising:

musical tone control means with which, during the generation of the musical tone by the musical tone generation means, the musical tone is controlled during the generation based on the position information that has been acquired by the position information acquisition means and the correction information that has been stored in the correction information storage means.

8. The electronic percussion instrument of claim 6, comprising:

musical tone control means with which, during the generation of the musical tone by the musical tone generation means, the musical tone is controlled during the generation based on the position information that has been acquired by the position information acquisition means and the correction information that has been stored in the correction information storage means.

9. An electronic percussion instrument, comprising:

a first pad, the first pad linkable to a rod;

a second pad, the second pad located in a location such that when the rod is moved, the first pad can contact the second pad;

a vibration sensor for providing a vibration sensor value based on vibrations of the first pad;

a displacement sensor for providing a displacement sensor value based on displacements of the first pad;

a position switch for providing a position switch value that reflects whether or not the first and second pads are joined together in a closed position; and circuitry for calculating an offset value as a difference between an actual value of the displacement sensor value when the first pad is in a first position and an expected value for the displacement sensor value when the first pad is in the first position, and for calculating a musical tone control value based on the offset value and based on the displacement sensor value when the first pad is in a second position;

wherein a sound source can be controlled to generate a musical tone based on the vibration sensor value and the musical tone control value.

10. The electronic percussion instrument of claim 9, wherein the vibration sensor is disposed on the first pad.

11. The electronic percussion instrument of claim 9, wherein the displacement sensor is arranged between the first pad and the second pad.

12. The electronic percussion instrument of claim 9, wherein the position switch is disposed on a rear surface of the second pad that comes into contact with the first pad when the first and second pads are in the closed position.

13. The electronic percussion instrument of claim 9, wherein the circuitry comprises a CPU, a ROM, and a RAM.

14. The electronic percussion instrument of claim 9, wherein the circuitry calculates the offset value by calculating a difference between the actual displacement sensor value when the first pad is in the first position and a closed position initialization value; and wherein the closed position initialization value is the expected value for the displacement sensor value when the first pad is in the first position.

15. The electronic percussion instrument of claim 14, wherein the circuitry performs the calculation to calculate the offset value when it is determined from the position switch value that the first pad has moved from the closed position to an open position in which the first pad is separated from the second pad.

16. The electronic percussion instrument of claim 14, wherein the closed position initialization value is the expected value for the displacement sensor value when the first pad enters the closed position.

17. The electronic percussion instrument of claim 16, wherein the closed position initialization value is "0".

18. The electronic percussion instrument of claim 9, wherein the second position is different from the first position.

19. The electronic percussion instrument of claim 9, wherein the second position is the same as the first position.

20. The electronic percussion instrument of claim 9, wherein the musical tone control value is used to control a timbre of the musical tone.

21. The electronic percussion instrument of claim 9, wherein the musical tone control value is used to control a pitch and an envelope level of the musical tone.

22. The electronic percussion instrument of claim 9, wherein the first pad is determined to be in the first position based on the position switch value.

23. The electronic percussion instrument of claim 22, wherein the position switch value is an "on" value when the first and second pads are in the closed position;

wherein the position switch value is an "off" value when the first and second pads are in an open position in which the first pad is separated from the second pad; and wherein the first pad is determined to be in the first position when the position switch value changes from "on" to "off".

24. A system for use with an electronic percussion instrument, the electronic percussion instrument having a first pad, a second pad, a displacement sensor for providing a displacement sensor value based on displacements of the first pad, and a position switch for providing a position switch value that reflects whether or not the first and second pads are joined together in a closed position, the system comprising:

circuitry for calculating an offset value as a difference between an actual value of the displacement sensor value when the first pad is in a first position and an expected value for the displacement sensor value when the first pad is in the first position, and for calculating a musical tone control value based on the offset value and based on the displacement sensor value when the first pad is in a second position;

wherein the musical tone control value can be used to cause a sound source to control a musical tone.

25. The system of claim 24, wherein the circuitry determines whether or not the first pad is in the first position based on the position switch value.

26. The system of claim 25, wherein the position switch value is a first value when the first and second pads are in the closed position;

wherein the position switch value is a second value when the first and second pads are in an open position in which the first pad is separated from the second pad; and wherein the circuitry determines that the first pad is in the first position when the position switch value changes from the first value to the second value.

27. The system of claim 24, wherein the musical tone control, value can be used to cause the sound source to control a timbre of the musical tone.

28. The system of claim 24, wherein the musical tone control value can be used to cause the sound source to control a pitch and an envelope level of the musical tone.

29. The system of claim 24, wherein the circuitry comprises a CPU, a ROM, and a RAM.

30. A method for causing a sound source to control a musical tone, the musical tone generated based on an operation of an electronic percussion instrument, the electronic percussion instrument having a first pad, a second pad, a displacement sensor for providing a displacement sensor value based on displacements of the first pad, and a position switch for providing a position switch value that reflects whether or not the first and second pads are joined together in a closed position, the method comprising the steps of:

detecting a first displacement value that is an actual value of the displacement sensor value when the first pad is in a first position;

determining an offset value as a difference between the first displacement value and an expected value for the displacement sensor value when the first pad is in the first position;

detecting a second displacement value that is an actual value of the displacement sensor value when the first pad is in a second position; and causing the sound source to control the musical tone based on the offset value and the second displacement value.

31. The method of claim 30, wherein the step of detecting a first displacement value that is an actual value of the displacement sensor value when the first pad is in a first position, comprises the step of:

detecting a first displacement value when the position switch value changes from a first position switch value to a second position switch value.

32. The method of claim 30, wherein the step of determining an offset value as a difference between the first displacement value and an expected value for the displacement sensor value when the first pad is in the first position, comprises the steps of:

retrieving a predetermined value that is an expected value for the displacement sensor value when the first pad is in the first position; and calculating an offset value as a difference between the first displacement value and the predetermined value.

33. The method of claim 30, wherein the step of detecting a second displacement value that is an actual value of the displacement sensor value when the first pad is in a second position, comprises the step of:

detecting a second displacement value that is an actual value of the displacement sensor value when the first pad is in a second position that is different from the first position.

34. The method of claim 30, wherein the step of causing the sound source to control the musical tone based on the offset value and the second displacement value, comprises the steps of:

calculating a musical tone control value based on the offset value and the second displacement value; and using the musical tone control value to cause the sound source to control the musical tone.

35. The method of claim 30, wherein the step of causing the sound source to control the musical tone based on the offset value and the second displacement value, comprises the step of:

causing the sound source to control a timbre of the musical tone based on the offset value and the second displacement value.

36. The method of claim 30, wherein the step of causing the sound source to control the musical tone based on the offset value and the second displacement value, comprises the step of:

causing the sound source to control a pitch and an envelope level of the musical tone based on the offset value and the second displacement value.

* * * * *